US011772940B2

(12) United States Patent
Meissner et al.

(10) Patent No.: US 11,772,940 B2
(45) Date of Patent: Oct. 3, 2023

(54) VEHICLE CRANE SYSTEM HAVING AN ATTACHMENT PART TRANSPORTING UNIT FOR A BRACING DEVICE, IN PARTICULAR A LATERAL SUPERLIFT, OF A VEHICLE CRANE

(71) Applicant: Tadano Demag GmbH, Zweibrücken (DE)

(72) Inventors: Klaus Meissner, Zweibrücken (DE); Matthias Roth, Waldmohr (DE); Klaus Königstein, Martinshöhe (DE)

(73) Assignee: Tadano Demag GmbH, Zweibrücken (DE)

( * ) Notice: Subject to any disclaimer, the term of this patent is extended or adjusted under 35 U.S.C. 154(b) by 312 days.

(21) Appl. No.: 17/266,454

(22) PCT Filed: Aug. 1, 2019

(86) PCT No.: PCT/EP2019/070757
§ 371 (c)(1),
(2) Date: Feb. 5, 2021

(87) PCT Pub. No.: WO2020/030520
PCT Pub. Date: Feb. 13, 2020

(65) Prior Publication Data

US 2021/0292136 A1 Sep. 23, 2021

(30) Foreign Application Priority Data

Aug. 8, 2018 (DE) ..... 102018119316.5

(51) Int. Cl.
*B66C 23/36* (2006.01)
*B66C 23/82* (2006.01)

(52) U.S. Cl.
CPC ..... *B66C 23/365* (2013.01); *B66C 23/826* (2013.01)

(58) Field of Classification Search
CPC ..... B66C 23/348; B66C 23/365; B66C 23/82; B66C 23/821; B66C 23/823; B66C 23/825; B66C 23/826; B66C 23/828
See application file for complete search history.

(56) References Cited

U.S. PATENT DOCUMENTS 3,954,193 A 5/1976 Whittingham
4,565,291 A * 1/1986 Khirwadkar ..... B66C 23/344 212/294

(Continued)

FOREIGN PATENT DOCUMENTS

DE 2833535 A1 2/1980
DE 19730361 A1 5/1998

(Continued)

OTHER PUBLICATIONS

International Search Report of the International Searching Authority from corresponding Patent Cooperation Treaty (PCT) Application No. PCT/EP2019/070757, indicated completed on Nov. 18, 2019.

(Continued)

*Primary Examiner* — Michael R Mansen
*Assistant Examiner* — Nathaniel L Adams
(74) *Attorney, Agent, or Firm* — Gardner, Linn, Burkhart & Ondersma

(57) ABSTRACT

A vehicle crane system includes a vehicle crane with an attachment part, in particular a bracing device, which can be mounted on and removed from the telescopic jib of the vehicle crane, and to an attachment part transporting unit for transporting an attachment part of a telescopic jib of the vehicle crane. A mobile transporting device is provided for transporting the attachment part and has at least one loading arm, the free supporting end of which can be coupled to the attachment part carried or to be carried on the transporting device. The loading arm is arranged movably on the transporting device such that the attachment part can be moved (Continued)

between the transporting device and the telescopic jib. Furthermore, the transporting device has a tilting device which is designed for raising and lowering one side of the attachment part carried or to be carried on the transporting device.

19 Claims, 17 Drawing Sheets

(56) References Cited

U.S. PATENT DOCUMENTS

| | | | | |
|---|---|---|---|---|
| 6,032,809 | A * | 3/2000 | Irsch | B66C 23/62 212/181 |
| 6,089,388 | A * | 7/2000 | Willim | B66C 23/82 212/178 |
| 7,568,881 | B1 | 8/2009 | Collins | |
| 9,150,390 | B2 * | 10/2015 | Willim | B66C 23/365 |
| 11,453,577 | B2 * | 9/2022 | Meissner | B66C 23/365 |
| 2010/0282700 | A1 * | 11/2010 | Richter | B66C 23/365 212/177 |
| 2020/0002139 | A1 * | 1/2020 | Backes | B66C 23/826 |
| 2021/0221658 | A1 | 7/2021 | Königstein | |
| 2021/0292135 | A1 | 9/2021 | Meissner et al. | |

FOREIGN PATENT DOCUMENTS

| | | | |
|---|---|---|---|
| DE | 19823380 | A1 | 3/1999 |
| DE | 202014007007 | U1 | 11/2014 |
| JP | S4952247 | U | 5/1974 |
| JP | 2016175754 | A | 10/2016 |
| WO | 2003074323 | A1 | 9/2003 |
| WO | 2005092775 | A1 | 10/2005 |

OTHER PUBLICATIONS

International Written Opinion of the International Searching Authority from corresponding Patent Cooperation Treaty (PCT) Application No. PCT/EP2019/070757, indicated completed on Nov. 18, 2019.

Preliminary Report on Patentability of the International Searching Authority in English from corresponding Patent Cooperation Treaty (PCT) Application No. PCT/EP2019/070757, completed Feb. 9, 2021.

* cited by examiner

VEHICLE CRANE SYSTEM HAVING AN ATTACHMENT PART TRANSPORTING UNIT FOR A BRACING DEVICE, IN PARTICULAR A LATERAL SUPERLIFT, OF A VEHICLE CRANE

CROSS REFERENCE TO RELATED APPLICATION

The present application claims the priority benefits of International Patent Application No. PCT/EP2019/070757, filed Aug. 1, 2019, and claims benefit of German patent application No. DE102018119316.5, filed on Aug. 8, 2018.

BACKGROUND AND FIELD OF THE INVENTION

The invention relates to a vehicle crane system, comprising a vehicle crane having an attachment part which can be mounted on its telescoping jib and can be removed therefrom, in particular a bracing device, and an attachment part-transport unit configured to transport the attachment part. Furthermore, the invention relates to a method for transferring an attachment part in the form of a bracing device from a transport apparatus of an attachment part-transport unit onto a telescoping jib of a vehicle crane, and a method for transferring an attachment part in the form of a bracing device from a telescoping jib, in particular from the basic box thereof, of a vehicle crane onto a transport apparatus of an attachment part-transport unit.

Typically, the factors determining how vehicle cranes, in particular mobile cranes, can be used are set by the structural design thereof. Technical variables such as load-bearing capacity, working radius and lifting height are determined essentially by the design of the respective telescoping jib. By using attachment parts which can be coupled to the telescoping jib, the variables of a vehicle crane can at times be changed in order for instance to increase its load-bearing capacity and reduce the elastic sagging of its telescoping jib. For this purpose, additional attachment parts in the form of at least one bracing device are known, the arrangement of which being used to achieve e.g. a reduction in the lever arm of the telescoping jib. The increase in bearing load rendered possible thereby is mostly produced by the combination with an additional counterweight and corresponding deflectors over the bracing device.

Owing to the mostly very considerable weight of such vehicle cranes, such cranes often arrive at their respective place of usage only in a partially disassembled manner in order to be able to respect the maximum values for the axle load and vehicle weight which are set for travelling on public roads. German laid-open document DE 198 23 380 A1 discloses in this context a crane jib-transport unit having a mobile transport apparatus in the form of a semi-trailer for transporting a main jib separate from a vehicle crane.

Independently thereof, the additional attachment parts in question mostly have dimensions and weights which require the separate transport thereof. For this purpose, suitable additional transport apparatuses are required in order to convey these to and from their respective place of usage. The subsequent displacement onto the telescoping jib and back requires an additional mobile lifting apparatus, by means of which the respective attachment part can be picked-up and transferred on-site. In view of the complexity required for this, there is thus still room for improvement in the transport and transfer of such attachment parts.

SUMMARY OF THE INVENTION

The present invention provides an improved apparatus for transporting and transferring an additional attachment part, as described previously, for the telescoping jib of a vehicle crane in such a manner that it is possible to perform the transporting and transferring in an overall more economical and practicable manner. Furthermore, two methods will be demonstrated which are used to simplify in particular the transferring of such an attachment part.

The vehicle crane system, comprising a vehicle crane having an attachment part which can be mounted on its telescoping jib and can be removed therefrom, in particular a bracing device, and an attachment part-transport unit in accordance with the invention configured to transport the attachment part, in this respect comprises a mobile transport apparatus configured to transport the attachment part and having at least one loading arm. The loading arm is designed such that its free load-bearing end can be coupled to the attachment part which is received, or is to be received, onto the transport apparatus. The loading arm is arranged so as to be movable on the transport apparatus such that the attachment part coupled to its free load-bearing end can be transferred between the transport apparatus and the telescoping jib. Furthermore, the transport apparatus has a tilting device which is configured to raise and lower, on one side, an attachment part which is received or is to be received on the transport apparatus.

An advantage resulting from the invention is the design—serving for combined usage—of the attachment part-transport unit which, going beyond the transport apparatus serving for separately conveying an attachment part, now also contains the suitable means for transferring the same. There is now no need for the otherwise typical requirement to use at least two separate apparatuses, of which one is used purely to transport the attachment part and the other is used to displace the attachment part between the telescoping jib and the transport apparatus. Owing to the reduction in the required apparatuses to a single unit, the attachment part-transport unit in accordance with the invention permits an extremely economical and practicable implementation of the measures required to convey and attach such an attachment part to the telescoping jib of a vehicle crane, in particular a mobile crane.

In accordance with a preferred development of the basic inventive concept, the tilting device of the attachment part-transport unit can have at least one support assembly and a tilting drive. In an advantageous manner, the tilting drive can be a linear drive or the tilting drive can contain at least one such linear drive. The advantage of a linear drive resides in its extremely compact design, compared with other drives, whilst still delivering high performance. The support assembly and the tilting drive provided for coupling to a first end section of the attachment part are configured to raise or lower a second end section, opposite the first end section, of the attachment part coupled to the tilting drive and supported at least in regions on the support assembly. For this purpose, the attachment part can be supported at least in part in an advantageous manner horizontally on the support assembly whilst it can be pivoted in a limited manner about the support assembly e.g. by changing the length of the tilting drive.

In accordance with the invention, the at least one loading arm can be arranged in a pivotable manner on the transport apparatus such that an attachment part to be loaded or unloaded can move on a path which contains a movement component in a vertical direction and also in a horizontal direction. Using the example of an attachment part configured as a bracing device, in particular a sideways superlift, a simple movement up and down onto/from the transport apparatus is provided, without an apparatus for transferring the attachment part being required for this purpose, the apparatus having to be additionally provided on site.

The at least one loading arm which is pivotable in order to load an attachment part, such as e.g. a bracing device, in a particularly preferred manner a sideways superlift, can advantageously be arranged on the transport apparatus such that an attachment part at least indirectly coupled to the free load-bearing end thereof and at the same time supported at least in sections or regions on the telescoping jib of a vehicle crane can move accordingly. By way of a pivoting movement of the loading arm, it is now possible to raise, at least on one side, the attachment part supported at least in part on a telescoping jib and to displace same on the telescoping jib, in particular in a sliding and/or rolling manner, owing to its then combined translational and limited rotational movement relative to the telescoping jib.

The cause for this is the bearing of the attachment part which occurs during this movement over two mutually spaced apart regions, namely on the at least one loading arm and the telescoping jib. In this manner, its end region supported on the telescoping jib can be displaced during the pivoting movement of the loading arm almost in parallel with the telescoping jib, while its opposite end region is moved on a circular path of the loading arm articulated on the transport apparatus.

The design in accordance with the invention makes provision that the attachment part supported on a telescoping jib of a vehicle crane and coupled with the tilting drive of the tilting device can be caused to move by a change in length of the tilting drive, which serves to set up or set down the attachment part in relation to the telescoping jib depending upon the direction of the change in length of the tilting drive. In an advantageous manner, the attachment part can be supported on a basic box of the telescoping jib. Accordingly, it is possible on the one hand to cause the attachment part to perform a first setting-up movement, which occurs relative to the transport apparatus and is a combined translational and limited rotational movement, away from the transport apparatus, in particular towards the vehicle crane. By reversing the direction of the change in length of the tilting drive, it is possible on the other hand to cause the attachment part to perform a second setting-down movement, which likewise occurs relative to the transport apparatus and is a combined translational and limited rotational movement, towards the transport apparatus, in particular away from the vehicle crane.

Furthermore, the design in accordance with the invention makes provision that the attachment part stored at least in sections on the telescoping jib of the vehicle crane and coupled to the free load-bearing end of the at least one loading arm can be caused—owing to a movement and/or change in length of the loading arm—to perform a movement dependent upon the pivoting direction and/or direction of the change in length of the loading arm and serving to set up or set down the attachment part in relation to the telescoping jib. Accordingly, it is possible on the one hand to cause the attachment part to perform a first setting-down movement, which occurs relative to the telescoping jib and is a combined translational and limited rotational movement, towards the transport apparatus, in particular away from the vehicle crane. By reversing the direction of the pivoting movement and/or change in length of the at least one loading arm, it is possible on the other hand to cause the attachment part to perform a second setting-up movement, which likewise occurs relative to the telescoping jib and is a combined translational and limited rotational movement, away from the transport apparatus, in particular towards the vehicle crane.

In both cases described above, the attachment part advantageously moves at least in part from the transport apparatus to the telescoping jib or from the telescoping jib to the transport apparatus without using an apparatus which would have to be provided separately.

Within the scope of the invention, it is advantageous if the attachment part to be transported and/or transferred using the attachment part-transport unit in accordance with the invention is a bracing device. In a particularly preferred manner, it can be at least one sideways superlift. Such a sideways superlift (SSL or also Y guying) is a sideways guying of the telescoping jib, the arrangement of which can occasionally considerably increase the bearing load thereof. Moreover, in particular in the case of long telescoping jibs, the sideways movements thereof caused e.g. by wind and solar radiation can also be reduced, which ultimately also increases the precision when working with a vehicle crane equipped in such a manner.

In an advantageous manner, the transport apparatus can be a semi-trailer. This can be produced entirely for the contemplated purpose, or can comprise a commercially available semi-trailer as a base. By selecting a semi-trailer which is suitable in terms of the required dimensions and bearing loads, this can be supplemented e.g. with the required components and thus can be economically assembled to form a transport apparatus in accordance with the invention.

Even though the drive required for transferring an attachment part could occur solely on the basis of the tilting drive in combination with a purely passive pivoting of the at least one loading arm, the invention advantageously provides an, in contrast, active pivotability of the at least one loading arm. In a particularly preferred manner, a combination of an active drive of the tilting drive and the at least one loading arm is provided. In particular, the preferred active pivotability of the at least one loading arm allows precise guidance of the attachment part coupled thereto, which is of great importance in terms of the possible dimensions and weight of such an attachment part, such as for instance a bracing device.

According to a particular development of the invention, a total of two loading arms can be provided, the arms then being arranged on the transport apparatus in a pivotable manner as a loading assembly. This permits an improved, i.e. more uniform, weight distribution of the attachment part, such as for instance a bracing device, to the loading arms. In addition, in use loading arms and the attachment part can then be positioned with respect to each other such that the attachment part is securely supported during loading thereof substantially via the two loading arms. The loading arms can be actuated such that the respective pivoting movement(s) thereof can be performed either synchronously with respect to each other and/or in a mutually independent manner. This can occur on the one hand by a rigid connection of the two loading arms, which effects the forcibly mechanical synchronisation thereof. On the other hand, the otherwise mutually independent mobility of the two loading arms can be actuated such that they are movable, as required, either synchronously with respect to each other and/or in a mutually independent manner. Depending upon how the loading arms are coupled, e.g. using a bracing device, the mutually independent mobility thereof permits in particular a precise adjustment of the orientation thereof, which may be advantageous in particular in the case of an attachment part-transport unit which is not ideally placed with respect to the telescoping jib of a vehicle crane.

With respect to the arrangement of the at least one pivotable loading arm or of the two pivotable loading arms, an articulation point which is as low as possible is considered to be advantageous. For instance, the transport apparatus can have a loading surface which faces a received and substantially horizontally oriented attachment part, such as for instance a bracing device. In this context, it is proposed to articulate the loading arm(s) via a rotational spindle beneath the loading surface so that the arm(s) can pivot about the rotational spindle. This allows a lowest possible centre of gravity for the proportionate weight transmission of a received attachment part into the transport apparatus and from there to the ground, e.g. via a running gear unit comprising wheels and/or chains. With respect to an articulation of the loading arm(s) which is possible on or above the loading surface, the low arrangement of the rotational spindle allows it/them to have a longer length, whereby the translational displacement of a received attachment part can be increased accordingly. In other words, a larger range can be achieved in relation to the displacement of an attachment part in parallel with the transport apparatus.

In terms of the drive of the loading arm(s), various designs are feasible such as for instance in the form of at least one rotational drive arranged in the region of the pivot bearing(s). Preferably, the attachment part-transport unit can have a pivot drive in the form of a linear drive integrated between the at least one loading arm and the transport apparatus. In the case of the preferred embodiment having two loading arms, such a pivot drive can be arranged between each of these loading arms and the transport apparatus.

The linear drive in terms of the invention can be any type of such drives which are driven e.g. via actuation of pressure, in particular pneumatically or preferably hydraulically. Accordingly, the linear drive can be e.g. a hydraulic cylinder. In addition or alternatively, this can also be driven via a transmission, in which a rotational movement of a motor is converted into a translational movement of the linear drive, such as e.g. by means of a threaded spindle transmission or ball screw transmission. In each case, a pivoting movement of the loading arm(s) is then based on a change in length of the linear drive(s).

According to a preferred development of the vehicle crane system, the loading arm or the preferably two loading arms can each be divided into a lower arm section and an upper arm section. The arm sections are then connected together via a joint, and so they can be foldable relative to each other. The foldability of the loading arm(s) permits more precise guidance of an attachment part since the additional joint provides a further degree of freedom in relation to the mobility of the at least one loading arm. In this manner, the coupled attachment part can e.g. also be lowered in a position of the at least one loading arm by bending same about the joint, which would otherwise not be possible owing to the otherwise fixed, in particular shortest, length and the thus fixed circular path of a pivoting movement of the loading arm.

In this context it is considered to be advantageous if the at least one loading arm has a joint drive which is located between the two arm sections thereof. In terms of the specific design of such a joint drive, this can be formed e.g. in the form of a length-adjustable linear drive in order to be able to perform the required folding movement of the loading arm about its joint.

In order to obtain an advantageous force ratio in relation to the loading arm(s) and pivot drive(s), it is considered to be advantageous if the, in particular respective, loading arm has a coupling region which is then used for the force-transmitting connection with the pivot drive. For instance, in particular the upper arm section thereof can have the coupling region and can be connected thereby to a first end of the pivot drive in a force-transmitting manner whilst a second end opposite the first end of the pivot drive is coupled to the transport apparatus. The coupling between the pivot drive and transport apparatus can occur e.g. via a bearing which is then arranged e.g. on or below the loading surface of the transport apparatus.

In relation to the form of the, in particular respective, loading arm, its end section comprising the free load-bearing end can preferably be bent towards a side of the loading arm facing away from the pivot drive.

According to an advantageous further development, it is feasible if the, in particular respective, loading arm is formed in a length-adjustable and in this respect telescopic manner. This means that its length can be changed as required, whereby e.g. a larger gap between the transport apparatus and the vehicle crane can be bridged accordingly. Alternatively or in combination, such an attachment part can also be received further onto the transport apparatus if necessary. For this purpose, the loading arm can be formed in multiple parts, e.g. in the form of multiple segments.

The mobile transport apparatus can be configured to move in an active or passive manner. This means that the attachment part-transport unit can be e.g. automatically driven and so this can be moved between its places of usage and/or for manoeuvring in a virtually automotive manner, i.e. by itself. Alternatively or in addition, this can also of course be entrained in the sense of a trailer in relation to its displacement capability. For this purpose, this can preferably be coupled to a suitable towing vehicle—such as for instance an articulated truck—which entrains the then pulled and/or pushed attachment part-transport unit.

According to a preferred development, the at least one loading arm or the loading assembly can be configured such that it can be operated from a region not necessarily located in the direct proximity. Typically, the drives, arranged on vehicles, for moving such apparatuses are operated e.g. via an operating unit arranged in and/or on the vehicle itself. In this case, the invention provides the advantageous option of operating the loading arm(s) from the outside. This means the operation from outside a vehicle cabin which, in the case of an e.g. automatically driven, mobile transport apparatus, can be part of the thus configured attachment part-transport unit. In a preferred configuration of the attachment part-transport unit, in which the mobile transport apparatus thereof is, or can be, coupled e.g. to a towing vehicle, the vehicle cabin can accordingly be part of this towing vehicle.

In a particular manner, the actuation of the loading arm and/or tilting device can occur by means of a wireless or wired operating unit. This provides the greatest flexibility for a person operating the attachment part-transport unit. The possibility of being spatially distant from the attachment part-transport unit offers a considerably better overview in order to ensure an extremely precise actuation of the loading arm and/or the tilting device despite the occasionally considerable dimensions of vehicle cranes and e.g. the main jib thereof. This is particularly the case in terms of the possibility e.g. for compensating for alignment errors and/or angular offsets during the transferring of the attachment part via the separate actuation of two loading arms.

According to a particular development, the tilting drive of the tilting device can be arranged in a pivotable manner on the transport apparatus via its first end. In this manner, the orientation of the tilting drive can follow the movement of the attachment part, which can be coupled thereto, in a stress-free manner. Furthermore, the tilting device can advantageously have a storage device on which the tilting drive can be placed, in particular in a position raised from the horizontal. The placed position of the tilting drive forms its lowest possible orientation relative to the loading surface of the transport apparatus, wherein the storage device ensures that the orientation of the tilting drive is always raised even in the placed state, which facilitates the coupling thereof to an attachment part.

In terms of the configuration of the support assembly of the tilting device, various forms are feasible which permit the capacity of the attachment part to be supported thereon, preferably horizontally. The support assembly can have a first protrusion and a second protrusion, wherein the two protrusions are spaced apart from each other, forming a depression. The depression delimited by the two protrusions represents a structural reception space for the attachment part, which permits distinct positioning of the attachment part which can be supported on the support assembly.

The vehicle crane system in accordance with the invention presented here permits the extremely economical and practicable implementation of the transport and transfer of an attachment part, in particular a bracing device, for a telescoping jib of a vehicle crane. Owing to the configuration in accordance with the invention, no additional apparatuses are required to be able to completely perform the measures required for the transport and transfer of the attachment part.

Furthermore, the invention is directed to a method in which an attachment part in the form of a bracing device is transferred from a transport apparatus of an attachment part-transport unit of a vehicle crane system onto a telescoping jib of a vehicle crane. The method comprises the following steps: providing the attachment part-transport unit having the received bracing device in the region of the vehicle crane; arranging a transport apparatus and telescoping jib relative to each other such that a longitudinal direction of the bracing device is oriented with respect to a longitudinal direction of the telescoping jib; coupling a tilting drive of a tilting device arranged on the loading surface of the transport apparatus to a first end section of the bracing device; actuating, in particular shortening, the tilting drive such that the bracing device supported at least in regions on a support assembly of the tilting device, in particular horizontally, is tilted about the support assembly until a second end section of the bracing device opposite the first end section is raised with respect to a loading surface of the transport apparatus; bringing the vehicle crane closer to the transport apparatus such that the telescoping jib is arranged at least in sections beneath the second end section of the bracing device; actuating, in particular lengthening, the tilting drive such that the bracing device is tilted back about the support assembly and the second end section thereof is lowered in the direction of a head section of the telescoping jib until the bracing device is supported on at least one support roller arranged on the telescoping jib, in particular on the basic box thereof; actuating, in particular further lengthening, the tilting drive such that the bracing device is lifted out of the support assembly and the bracing device is placed at least in sections on the telescoping jib, in particular on the basic box thereof, via a first setting-up movement which occurs in a sliding and/or rolling manner about the support roller of the telescoping jib and is a combined translational and limited rotational movement; orienting two length-adjustable loading arms arranged on the transport apparatus by actuating—in a parallel or mutually separate manner—at least one pivot drive pivoting the loading arms and the length adjustability thereof until the free load-bearing ends thereof are coupled in each case to a coupling point of the bracing device, the coupling point being particularly located in the region of the first end section; decoupling the tilting drive of the tilting device from the bracing device; pivoting and/or lengthening the two loading arms until the bracing device supported via its second end section on the telescoping jib in a sliding and/or rolling manner is raised from the support roller of the telescoping jib; actuating, at the same time or following the pivoting and/or lengthening of the two loading arms, a joint drive arranged between two arm sections, connected together in an articulated manner, of each loading arm such that an upper arm section is folded down against a lower arm section of the respective loading arm; actuating, in a parallel or mutually separate manner, the pivot drive and the joint drive and a length-adjustability of the loading arms such that a second setting-up movement, which is a combined translational and limited rotational movement, is performed in particular until the bracing device is placed completely on the telescoping jib; actuating, in particular lengthening, a luffing cylinder of the vehicle crane such that its telescoping jib is raised from the transport apparatus until the coupling points of the bracing device are decoupled from the free load-bearing ends of the two loading arms; actuating, in a parallel or mutually separate manner, the pivot drive and the joint drive until the two loading arms are pivoted back in the direction of the loading surface of the transport apparatus.

In an advantageous manner, during or at the end of the first setting-up movement the bracing device can be supported on the support roller of the telescoping jib via at least one projection arranged thereon.

According to a particular development of the method in accordance with the invention, the tilting drive of the tilting device can be actuated after being decoupled from the bracing device such that it is shortened. In this manner, the tilting drive moves outside the movement radius of the attachment part in order to prevent any possible collisions. In addition, the lever arm of the tilting drive is shortened, which reduces the loading thereof in particular during the movement of the attachment part-transport unit.

According to a particular development of the method in accordance with the invention, the bracing device can be connected, in its state fully placed on the telescoping jib, to the telescoping jib, in particular to its basic box, via at least one attachment means, in particular bolts, in order to achieve a fixed detachable connection therebetween.

Furthermore, the invention is directed to a method in which an attachment part in the form of a bracing device is transferred from a telescoping jib, in particular from its basic box, of a vehicle crane onto a transport apparatus of an attachment part-transport unit of a vehicle crane system. The method comprises the following steps: providing the attachment part-transport unit in the region of the vehicle crane comprising the telescoping jib with the bracing device located thereon; as required, actuating, in particular lengthening, a luffing cylinder of the vehicle crane such that the telescoping jib is raised; arranging the transport apparatus at least in sections below the telescoping jib and orienting a longitudinal direction of the transport apparatus with respect to a longitudinal direction of the telescoping jib of the vehicle crane and/or a longitudinal direction of the bracing device; orienting two length-adjustable loading arms arranged on the transport apparatus by actuating—in a parallel or mutually separate manner—at least one pivot drive pivoting the loading arms and a joint drive arranged between two arm sections, connected to each other in an articulated manner, of each loading arm, and the length adjustability thereof until the free load-bearing ends thereof are arranged in each case below a coupling point of the bracing device, the coupling point being particularly located in the region of a first end section of the bracing device; actuating, in particular shortening, the luffing cylinder of the vehicle crane such that the telescoping jib is lowered towards a loading surface of the transport apparatus until coupling points arranged on the bracing device are coupled to the free load-bearing ends of the loading arms, in particular supported thereon;

actuating, in a parallel or mutually separate manner, in particular shortening, the pivot drive and, in particular lengthening, the joint drive and the length-adjustability, in particular lengthening, of the loading arms such that a first setting-down movement, which is a combined translational and limited rotational movement, is performed until a first end section, facing the transport apparatus, of the bracing device—which is supported on the telescoping jib in a sliding and/or rolling manner via its second end section opposite the first end section—is raised from the telescoping jib; actuating, in a parallel or mutually separate manner, in particular shortening, the pivot drive and/or length-adjusting, in particular shortening, the two loading arms in such a manner until the bracing device, supported on the telescoping jib, in particular its basic box, in a sliding and/or rolling manner via its second end section, is placed with its first end section at least in part protruding over a head section of the telescoping jib on the telescoping jib, in particular on its basic box; actuating, in a parallel or mutually separate manner, in particular shortening, the pivot drive and/or length-adjusting, in particular shortening, the two loading arms such that their free load-bearing ends are decoupled from the coupling points of the bracing device and are lowered in the direction of the loading surface of the transport apparatus; coupling a tilting drive of a tilting device arranged on the loading surface of the transport apparatus to the at least partially protruding first end section of the bracing device; actuating, in particular shortening, the tilting drive such that the bracing device is tilted via a second setting-down movement, which is combined translational and limited rotational movement and is effected about at least one support roller arranged on the telescoping jib, in particular on its basic box, until the second end section of the bracing device is raised from the telescoping jib, in particular its basic box, and the first end section of the bracing device, supported on the support roller in a sliding and/or rolling manner, is supported at least in regions on a support assembly of the tilting device; actuating, in particular further shortening, the tilting drive such that the bracing device is tilted about the support assembly until the bracing device is completely raised from the telescoping jib, in particular from its basic box; moving the vehicle crane away from the attachment part-transport unit until the telescoping jib is moved out of a region located between the tilted bracing device and the loading surface of the transport apparatus; actuating, in particular lengthening, the tilting drive such that the bracing device is tilted back about the support assembly and is lowered in the direction of the loading surface of the transport apparatus until the second end section of the bracing device is supported at least in part on the loading surface of the transport apparatus;

decoupling the tilting drive of the tilting device from the bracing device.

In an advantageous manner, during or at the end of the second setting-down movement the bracing device can be supported on the support roller of the telescoping jib via at least one projection arranged thereon.

According to a particular development of the method in accordance with the invention, the tilting drive of the tilting device can be actuated such that it is lengthened prior to being coupled to the first end section of the bracing device and/or is shortened after being decoupled from the bracing device.

According to a particular development of the method in accordance with the invention, the particular attachment means connecting the bracing device to the telescoping jib, in particular bolting, can be released prior to raising the bracing device from the telescoping jib. In this manner, the bracing device can be displaced relative to the telescoping jib and so a transfer onto the transport apparatus can be effected.

The advantages achieved by the respective method in accordance with the invention have already been disclosed or at least analogously discussed in conjunction with the attachment part-transport unit in accordance with the invention and so at this juncture reference is made to the previous statements in that regard to avoid repetition.

Of course, the methods in accordance with the invention which have been described in greater detail above using the example of a bracing device for a telescoping jib of a vehicle crane can also be applied to other attachment parts. This depends upon the configuration and incorporation of the respective attachment part, also with the measure(s) related to a luffing cylinder being deleted and/or adapted analogously.

An exemplified embodiment of the invention will be explained in greater detail with reference to the following description.

DESCRIPTION OF THE PREFERRED EMBODIMENTS

Figure 1:
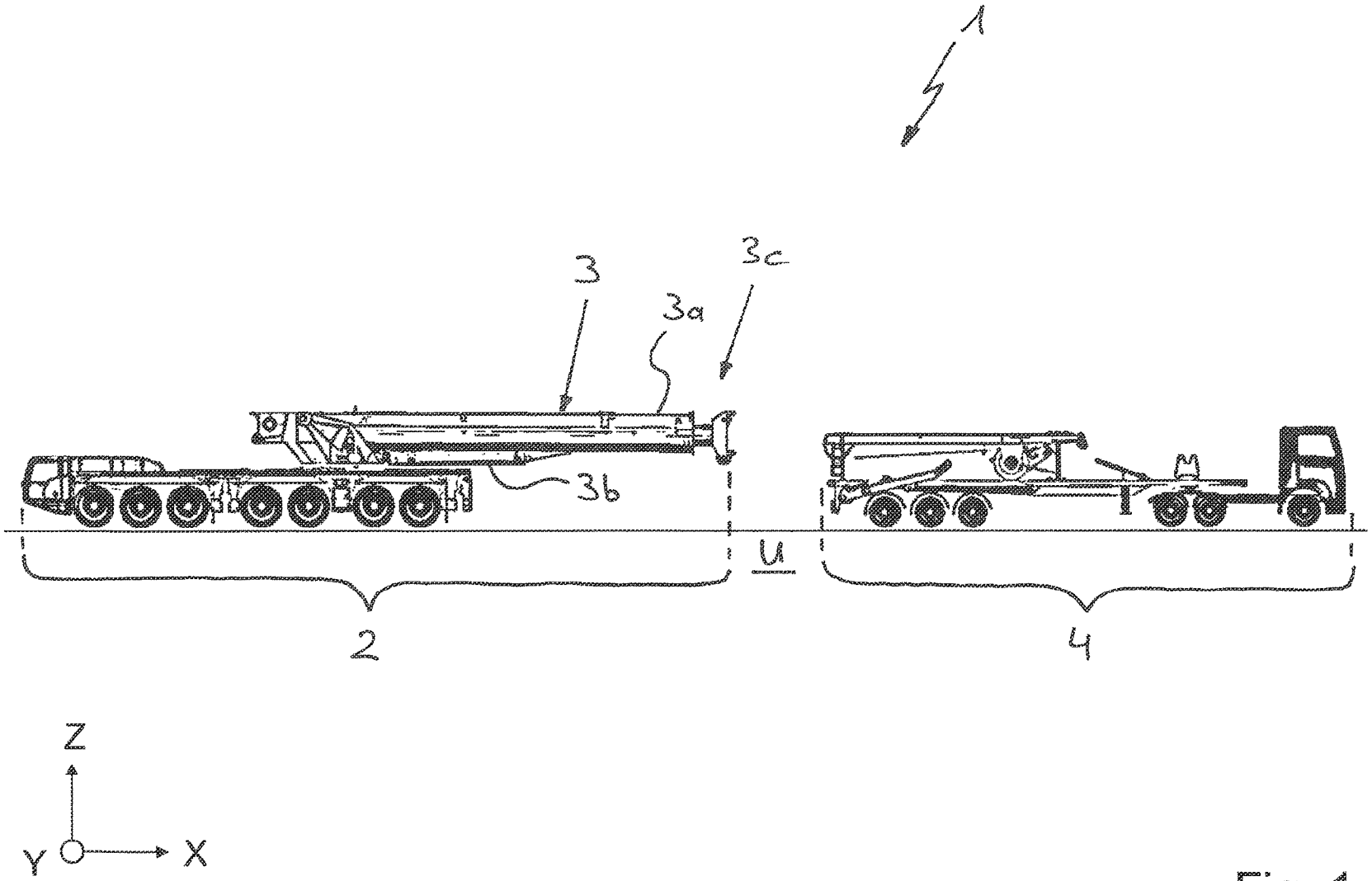
FIG. 1 shows a vehicle crane system in accordance with the invention in a side view.

FIG. 1 shows the structure of a vehicle crane system 1 in accordance with the invention which is parked on a ground U and which comprises a vehicle crane 2 having a telescoping jib 3 extending in parallel with a horizontal direction X and an attachment part-transport system 4 in accordance with the invention. Typically, the telescoping jib 3 is formed from a basic box 3*c* and telescoping sections guided therein in such a manner so as to be hydraulically length-adjustable and lockable. The head section 3*c* of the telescoping jib 3 can be raised and lowered in a manner not illustrated in more detail here via a luffing cylinder 3*b*.

Figure 2:
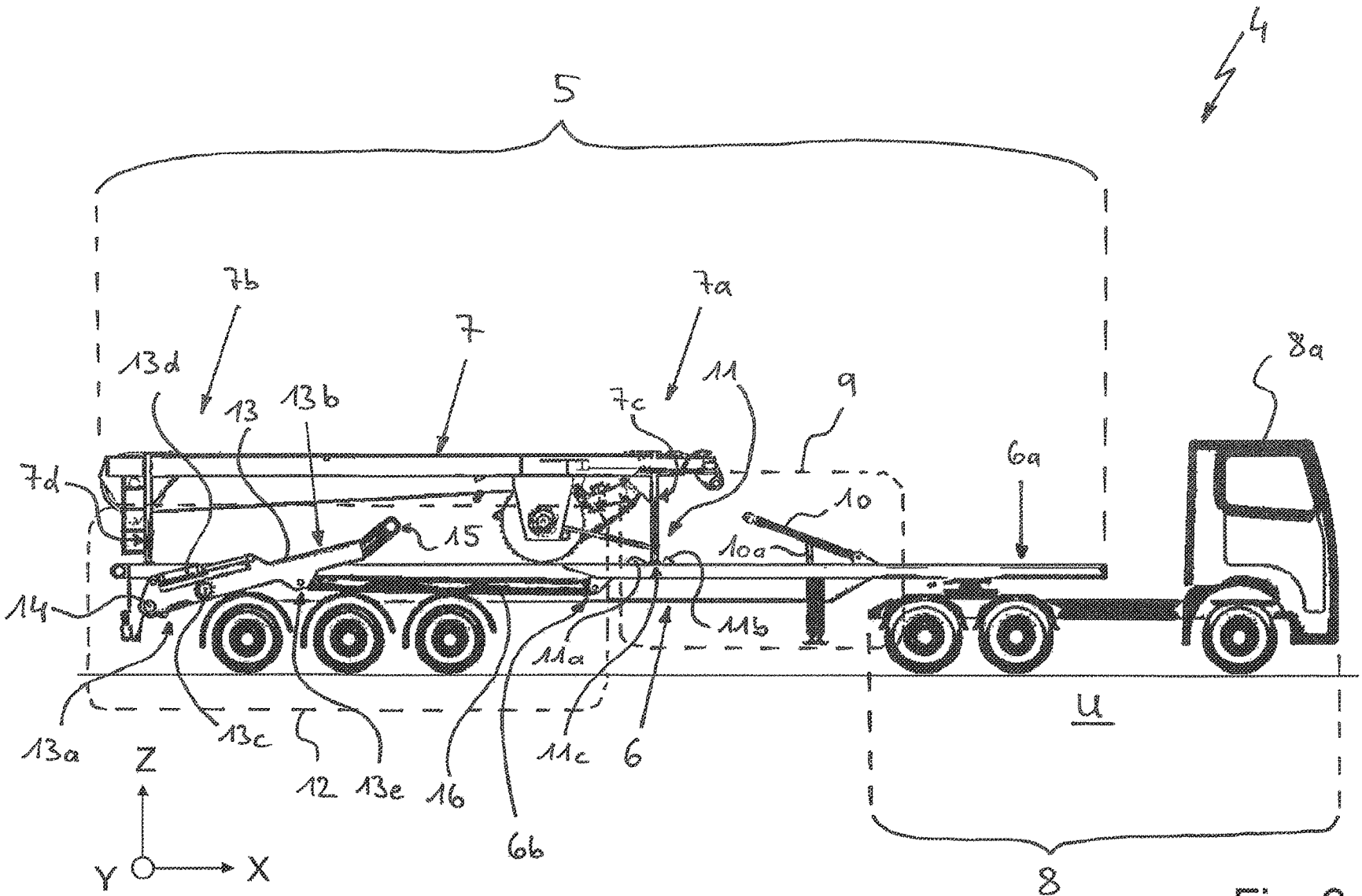
FIG. 2 shows a part of the vehicle crane system 1 of FIG. 1 in the form of an attachment part-transport unit.

FIG. 2 shows the attachment part-transport system 4, in accordance with the invention, of FIG. 1 illustrated in isolation from the vehicle crane 2. In this view, it becomes clear that the attachment part-transport system 4 has an attachment part-transport unit 5 with a mobile transport apparatus 6 which likewise extends in parallel with the horizontal direction X. The transport apparatus 6 is used to receive an attachment part 7—which in FIG. 2 is already placed on the loading surface 6*a* of the transport apparatus facing away from the ground U. The dimensions of the loading surface 6*a* in parallel with the horizontal direction X and also in parallel with a transverse direction Y extending perpendicular to the plane of the page offer sufficient space on which the attachment part 7 can be supported. In the present case, the attachment part 7 is a bracing device, in particular a sideways superlift, which is provided for attachment to a basic box 3*a* of the telescoping jib 3. The bracing device can have bracing arms which are arranged behind in each other in the transverse direction Y and are connected to each other in a pivotable manner via a connecting element, which is not shown in more detail and is located in the region of a second end section 7*b* of the bracing device 6, in such a manner that the bracing arms can be oriented in a V-shaped manner with respect to each other as required, forming an angle. The attachment part 7 will thus be referred to as bracing device 7 hereinafter.

The transport apparatus 6 can be e.g. a semi-trailer—as shown in the present case—an attached trailer, a low loader or a trailer, to name just some of the possible embodiments.

As can be seen, the transport apparatus 6 is formed as a semi-trailer. Its mobility is determined by the coupling to a towing vehicle 8 of the attachment part-transport system 4 which, in the form of an articulated truck, is coupled to the transport apparatus 6. The towing vehicle 8 has a vehicle cabin 8*a*, from which the combination of the attachment part-transport system 4 consisting of the towing vehicle 8 and attachment part-transport unit 5 can be controlled in a typical manner in particular in relation to the transport of the bracing device 7.

A tilting device 9 is provided on the transport apparatus 6 and is arranged on the loading surface 6*a* of the transport apparatus 6 approximately in the centre in relation to the transverse direction Y. The tilting device 9 is configured to raise and lower, on one side, the bracing device 7 already received on the loading surface 6*a* of the transport apparatus 6 in FIG. 2. For this purpose, the tilting device 9 has a tilting drive which is configured as a linear drive in the embodiment shown here. The tilting drive 10 is arranged on the loading surface 6*a* of the transport apparatus 6 in a pivotable manner via its first end, wherein a storage device 10*a* of the tilting device 9 is used to keep the tilting drive 10, which can be placed thereon in its lowermost pivoting position, in a position raised from a horizontal or horizontal direction X. Furthermore, the tilting device 9 has a support assembly 11 which is arranged on the loading surface 6*a* and has a first protrusion 11*a* and a second protrusion 11*b*. The two protrusions 11*a*, 11 *b* are spaced apart from each other in parallel with the horizontal direction X such that they include or form a depression 11*c* therebetween. On a first end section 7*a*, facing the tilting drive 10, and on a second end section 7*b*, facing away from the tilting drive 10, of the bracing device 7, this has a lateral element in the form of two limbs 7*c*, 7*d* which are spaced apart from each other in relation to the transverse direction Y and extend perpendicularly in parallel with a vertical direction Z. The foot points of the limbs 7*c* arranged on the first end section 7*a* of the bracing device 7 lie within the depression 11*c* and so the bracing device 7 can be tilted by horizontally supporting the two limbs 7*c* on the second protrusion 11*b* via the foot points thereof.

In accordance with the invention, the attachment part-transport unit 5 additionally has a loading assembly 12 which is arranged in the region of the end of the transport apparatus 6 opposite the towing vehicle 8. In this case, the loading assembly 10 has two loading arms 13, of which, with reference to the view of FIG. 2, only the loading arm 13 positioned in the foreground can be seen, whilst the rear loading arm 13 which extends in this case in parallel therewith and is perpendicular to the plane of the page in relation to the transverse direction Y is concealed by the loading arm 13 positioned in the foreground. Both loading arms 13 are articulated to the transport apparatus 6 in a pivotable manner via a common or in each case a dedicated rotational spindle 14 below the loading surface 6*a*. The loading assembly 12 is used in combination with the tilting device 9 to transfer the bracing device 7. For this purpose, the two loading arms 13 can be pivoted by means of an active rotation about the rotational spindle(s) 14, which rotation is possible in the same or opposite directions.

The free load-bearing ends 15 of each loading arm 13 are provided for at least indirect coupling, over time, to the bracing device 7, in order to move these in terms of their transfer on a path with a movement component in the vertical direction y and horizontal direction X. The active rotation of the loading arms 13 is effected via two pivot drives 16, of which, on account of the view of FIG. 2, likewise only the pivot drive 16 positioned in the foreground can be seen. The two pivot drives 16 are configured as length-adjustable linear drives, which can preferably be hydraulic cylinders. It is of course likewise feasible to use electric drives. Each of these two pivot drives 16 is integrated between the transport apparatus 6 and one of the two loading arms 13. With regard to the loading arm 13 which is positioned in the foreground and is substantially identical in form to the concealed loading arm 13, it becomes clear that they are each divided into a lower arm section 13*a* and an upper arm section 13*b*. The two arm sections 13*a*, 13*b* are connected together via a joint 13*c* and can be folded relative to each other. For this purpose, a joint drive 13*d* is provided on each of the two loading arms 13 and is connected on each end side to the lower arm section 13*a* and also to the upper arm 13*b* in an articulated manner. It can be seen that the joint drive 13*d* is configured as a length-adjustable linear drive, which can preferably be in each case a hydraulic cylinder. It is of course likewise feasible to use electric drives.

Each upper arm section 13*b* of the two loading arms 13 has a coupling region 13*e* which in each case is arranged on a side of the associated loading arm 13 facing away from the joint drives 13*d*. In contrast, the transport apparatus 6 has two bearings 6*b* which are arranged below its loading surface 6*a* and are each located substantially in the plane of one of the two pivot drives 16. The two pivot drives 16 are integrated between the transport apparatus 6 and the respectively associated loading arm 13 such that they are connected to the coupling region 13*e* of a loading arm 13 in a force-transferring manner via a first end, whereas the second ends thereof opposite the first end are each coupled to one of the bearings 6*b*. In this arrangement, the free load-bearing ends 15 of each loading arm 13 are bent towards a side facing away from the associated linear drive 16.

Figure 3:
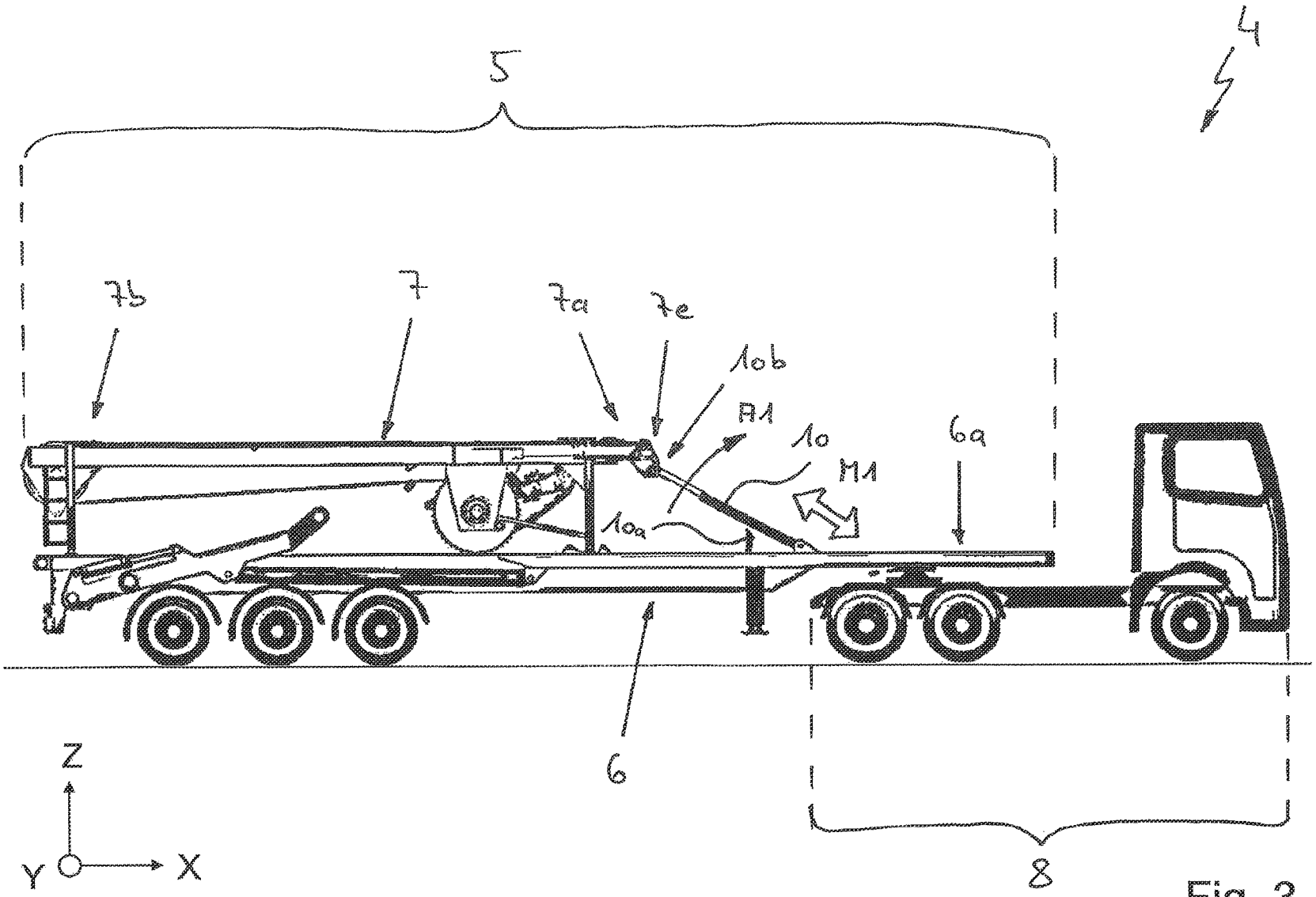
FIG. 3 shows the attachment part-transport unit of FIG. 2 in a first state.

FIGS. 3 to 17, described in more detail hereinafter, show successive measures to transfer the bracing device 7 between the transport apparatus 6 of the attachment part-transport unit 5 and the telescoping jib 3 of the vehicle crane 2:

FIG. 3 illustrates the attachment part-transport system 4, provided in the region of the vehicle crane 2 not shown here for reasons of clarity, consisting of the towing vehicle 8 and attachment part-transport unit 5 having the bracing device 7 received on the transport apparatus 6 thereof. In a manner not shown in more detail here, the transport apparatus 6 and the telescoping jib 3 of the vehicle crane 2 are arranged relative to each other such that the longitudinal direction of the bracing device is oriented towards the longitudinal direction of the telescoping jib 3. In order to be able to raise the second end section 7*b* of the bracing device 7 which in this case is still completely placed on the loading surface 6*a* of the transport apparatus 6, a second (free) end 10*b* of the tilting drive 10 was suitably coupled to the first end section 7*a* of the bracing device 7. For this purpose, the tilting drive 10 was raised from its position placed on the support device 10*a* by means of a manual raising movement A1, wherein by way of a linear movement M1 lengthening the tilting drive 10 the second end 10*b* thereof was displaced towards a connecting region 7*e* of the first end section 7*a* of the bracing device 7 and was connected thereto; e.g. by means of a bolt.

Figure 4:
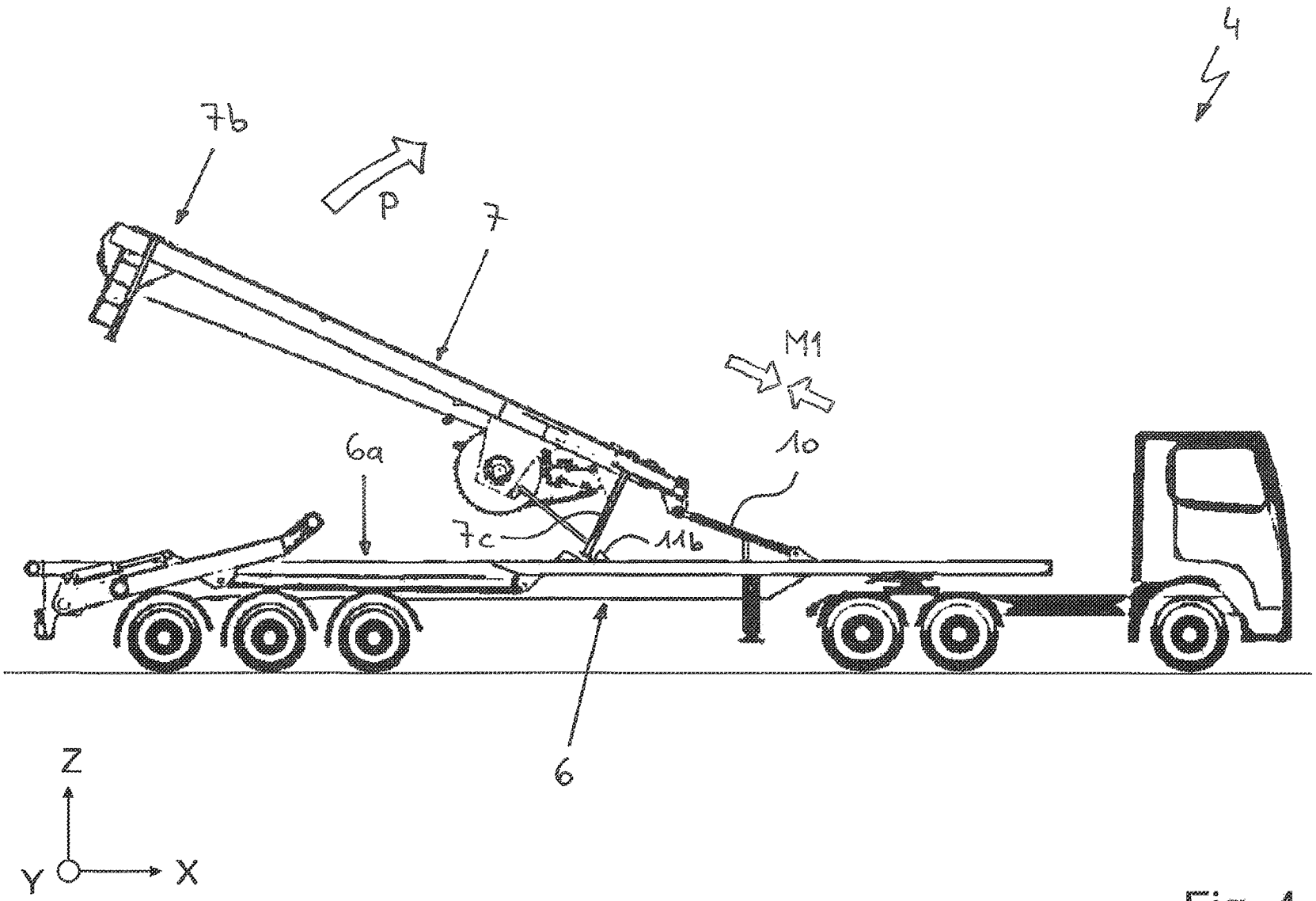
FIG. 4 shows the attachment part-transport unit of FIG. 3 in a changed state.

FIG. 4 shows the raised state of the second end section 7*b* of the bracing device 7. For this purpose, the tilting drive 10 coupled to the bracing device 7 was actuated again, wherein by way of a linear movement M1 shortening the tilting drive 10 the first end section 7*a* of the bracing device 7 was pulled up on the tilting drive 10. By way of the thereby activated horizontal support of the bracing device 7 via the foot point of the limbs 7*c* thereof at the second protrusion 11*b* of the support assembly 11, the bracing device 7 was tilted about the support assembly 11 via a tilting movement P such that the second end section 7*b* of the bracing device 7 is now raised from the loading surface 6*a* of the transport apparatus 6.

Figure 5:
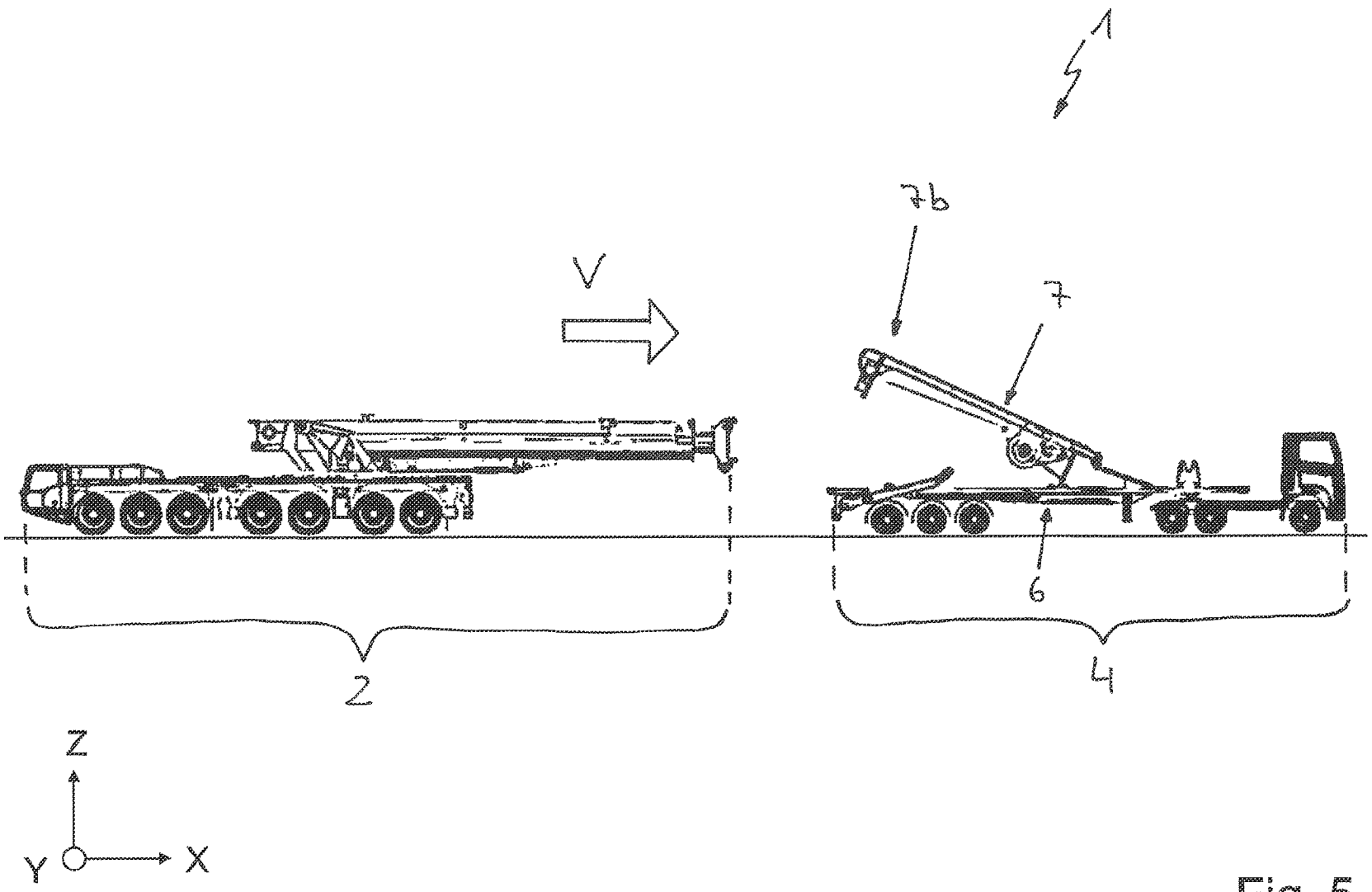
FIG. 5 shows the vehicle crane system of FIG. 1 in a changed state.

FIG. 5 shows an overview of the vehicle crane system 1, wherein the bracing device 7 is shown with its second end section 7*b* still in the raised state. In the next step, the vehicle crane 2 is now brought closer to the transport apparatus 6 of the attachment part-transport system 4 by means of a travelling movement V. Of course, the travelling movement V can also occur in the opposite direction, whereby the attachment part-transport system 4 can also be brought closer to the vehicle crane 2.

Figure 6:
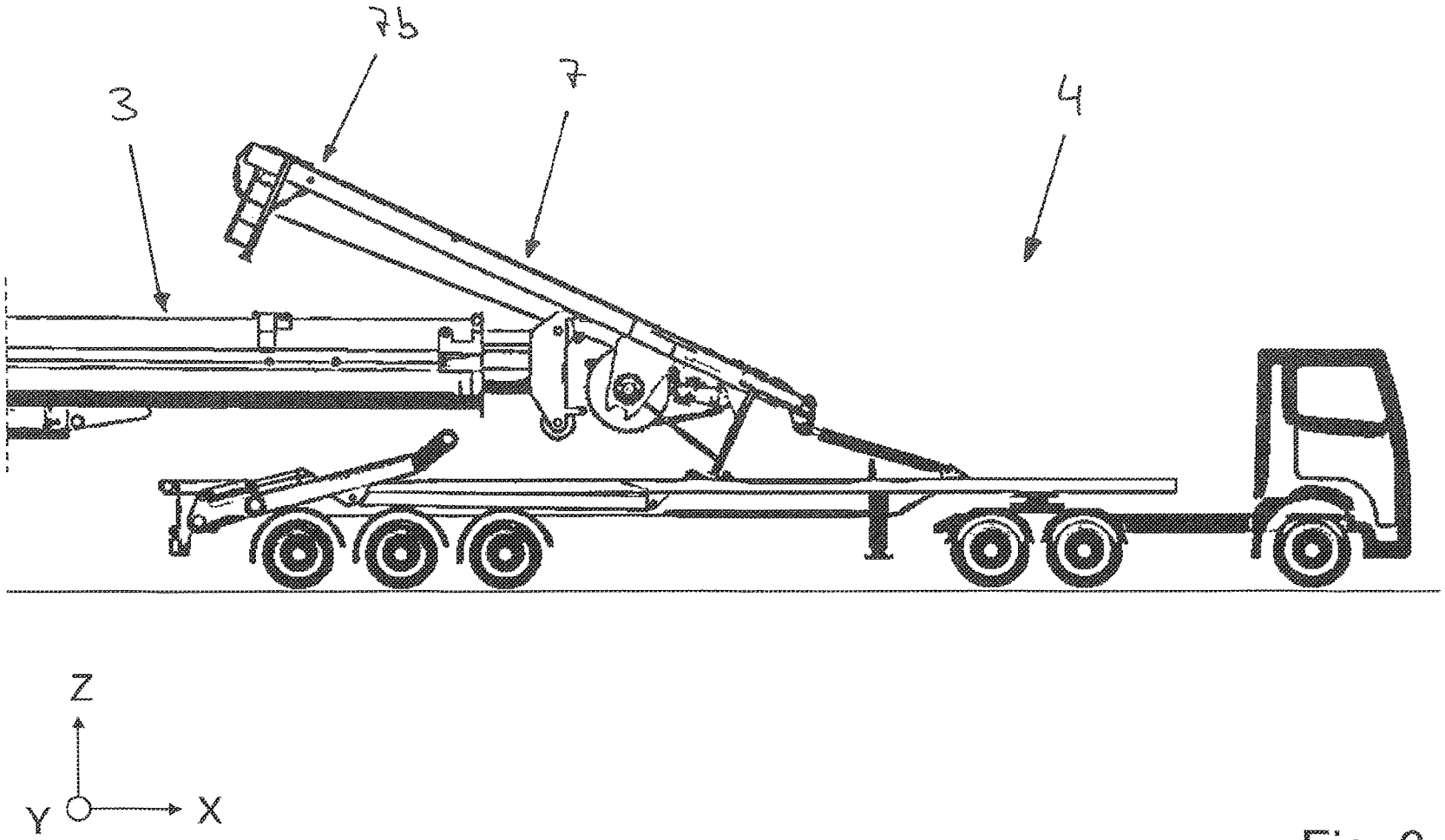
FIG. 6 shows the attachment part-transport unit shown in FIG. 5 together with a part of a vehicle crane of FIGS. 1 and 5 in a changed state.

FIG. 6 shows the state, required for the next steps, in which the vehicle crane 2—which in this case can be seen with only a section of its telescoping jib 3—has been brought closer to the transport apparatus 6 of the attachment part-transport system 4. The preceding travelling movement V of the vehicle crane 2 occurred only until the telescoping jib 3 is located in sections beneath the second end section 7*b* of the bracing device 7.

Figure 7:
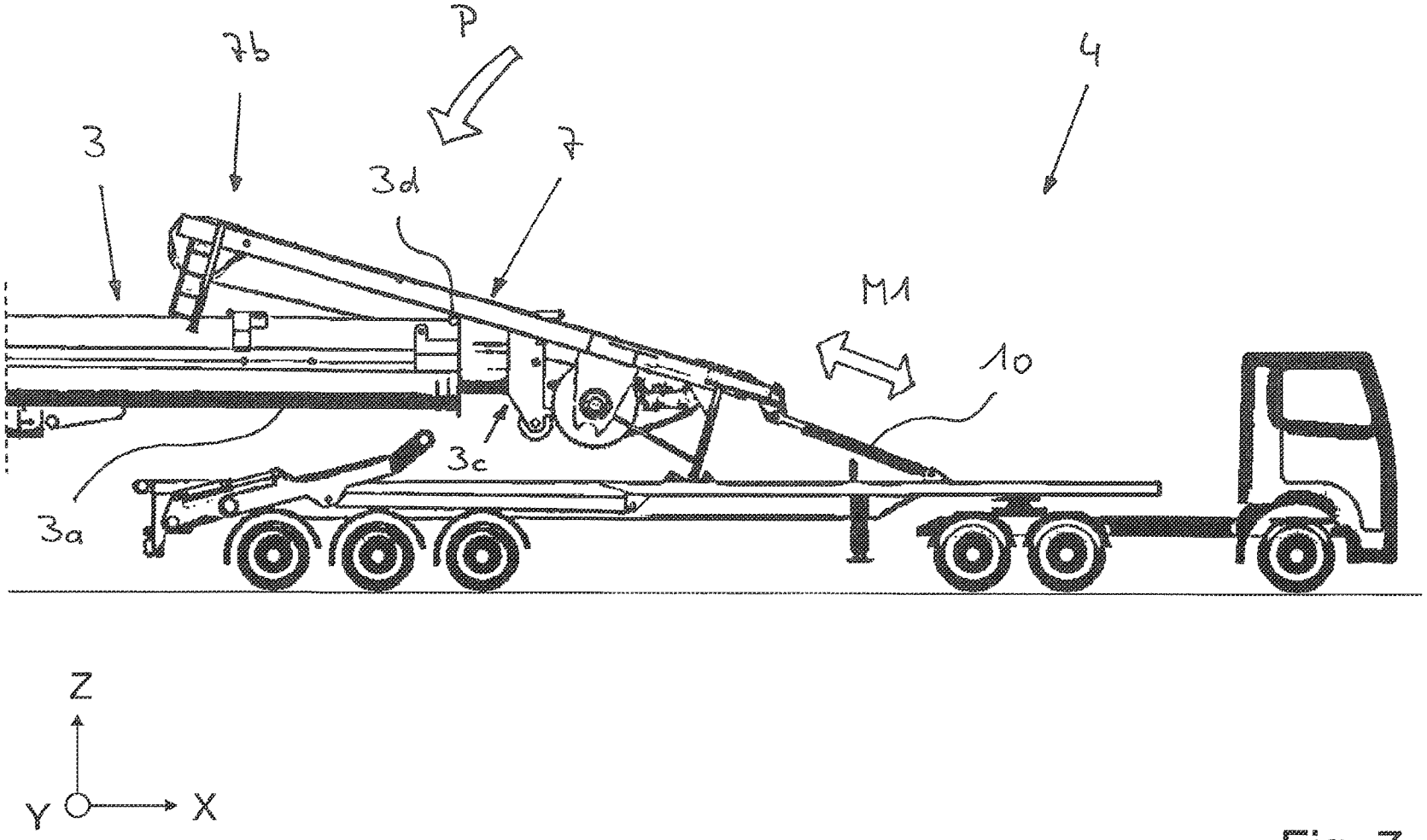
FIG. 7 shows the attachment part-transport unit together with the vehicle crane part of FIG. 6 in a changed state.

FIG. 7 illustrates the subsequent lowering of the second end section 7*b* of the bracing device 7 in the direction of the telescoping jib 3. For this purpose, the tilting drive 10 was again actuated, whereupon the tilting movement P of the bracing device 7 resulting from the linear movement M1 lengthening the tilting drive 10 occurred about the support assembly 11. As a result, the second end section 7*b* of the bracing device 7 was lowered in the direction of the head section 3*c* of the telescoping jib 3 until the bracing device 7 was supported on a support roller 3*d* arranged on the free end of the basic box 3*a*.

Figure 8:
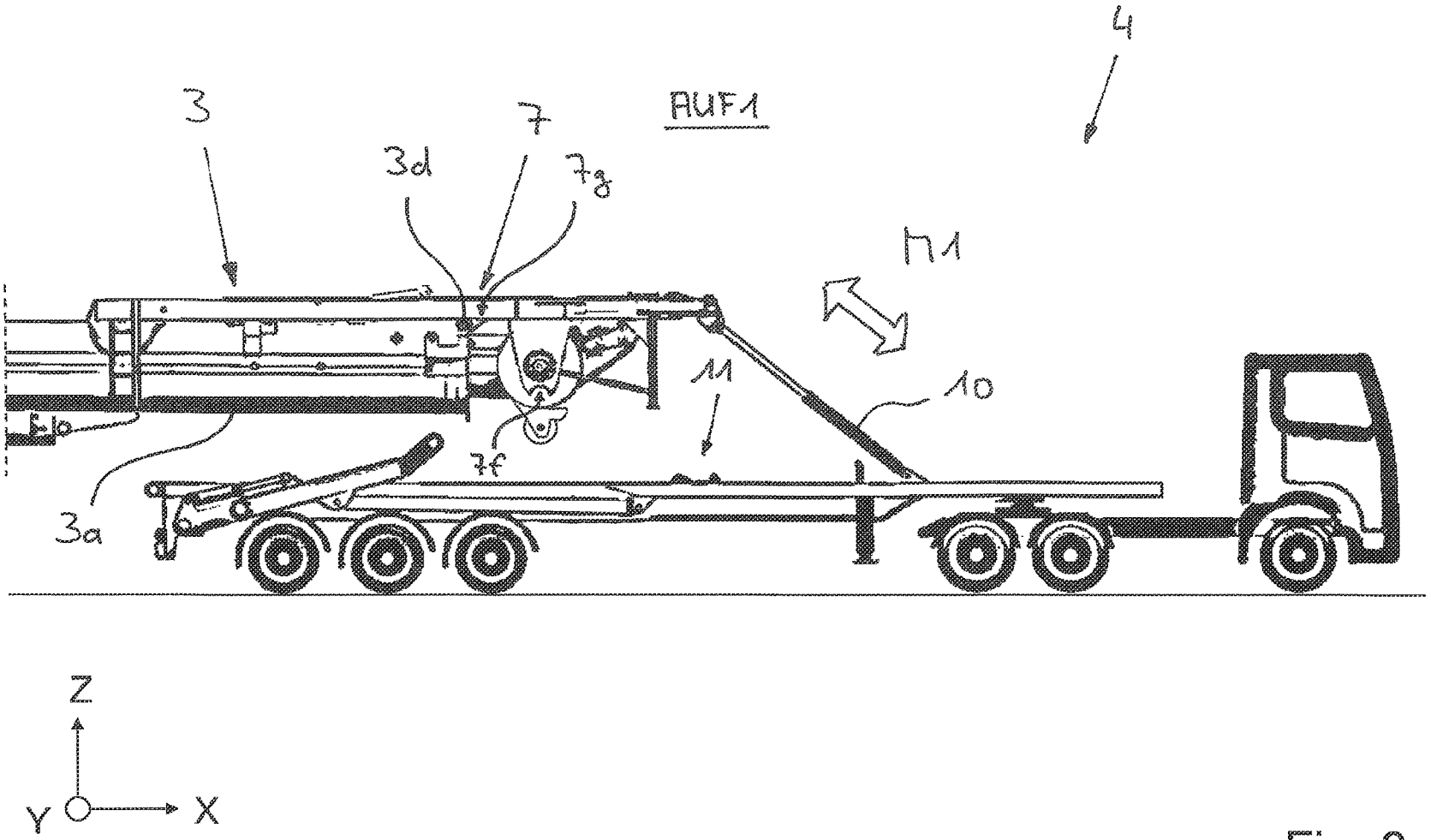
FIG. 8 shows the attachment part-transport unit together with the vehicle crane part of FIG. 7 in a changed state.

FIG. 8 shows the placement, at least in sections, of the bracing apparatus 7 on the basic box 3*a* of the telescoping jib 3. This state was reached in that, by way of a linear movement M1 further lengthening the tilting drive 10, the bracing device 7 was initially lifted out of the support assembly 11. Owing to the forcibly set kinematics, the further lengthening of the tilting drive 10 produced a first setting-up movement AUF1 which occurs in a sliding and/or rolling manner about the support roller 3*d* of the telescoping jib 3 and is a combined translational and limited rotational movement. In order to initiate the lowering of the second end section 7*b* and in order to limit the extent to which the bracing device 7 is located on the basic box 3*a* of the telescoping jib 3, the bracing device 7 comprises at least one projection 7*g*, the support roller 3*d* being brought closer to the projection during the first setting-up movement AUF1 and ultimately being supported thereon. In this manner, the displacement of the bracing device 7 in parallel with the horizontal direction X is limited and the tilting movement P is already structurally initiated.

Figure 9:
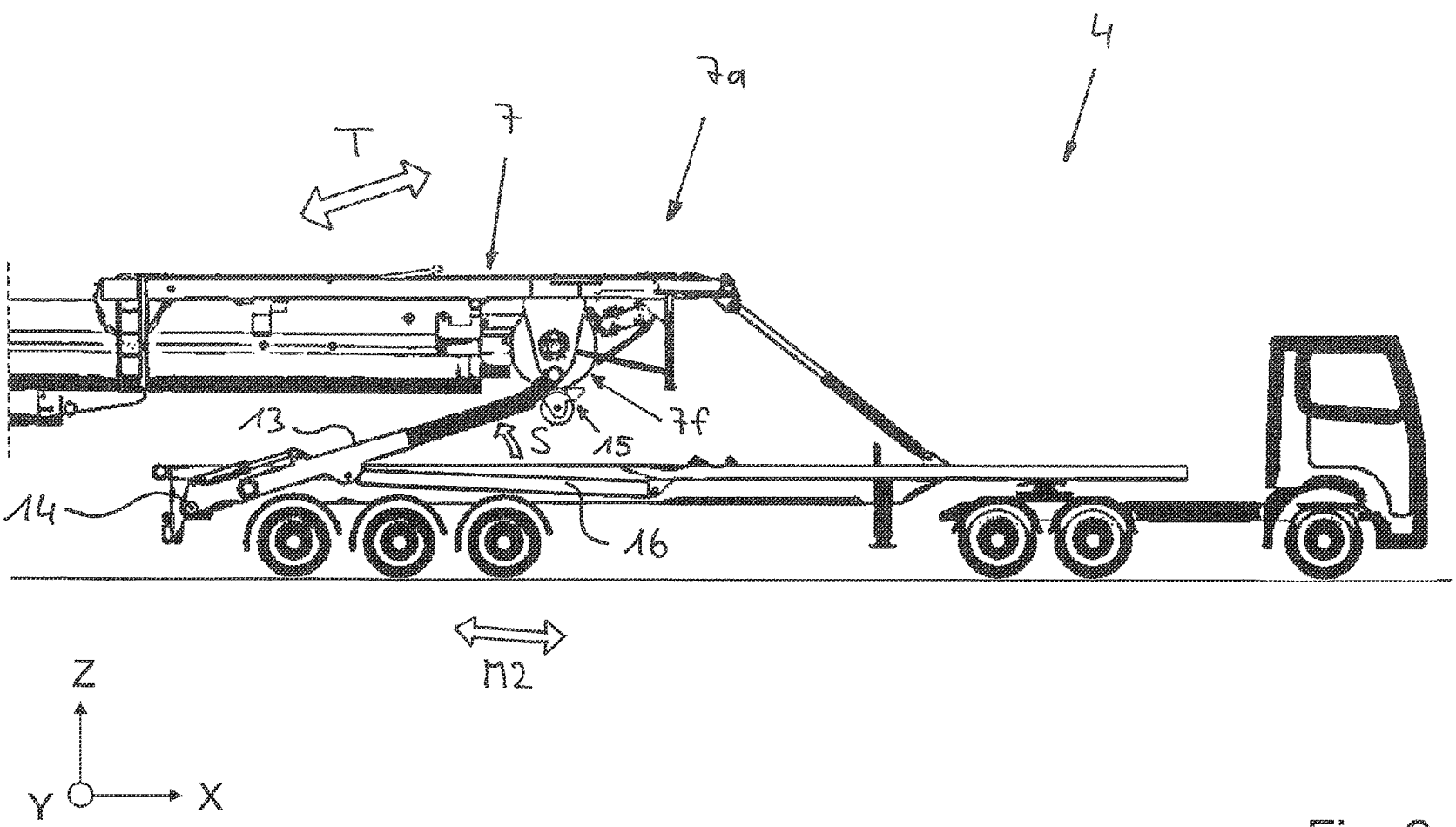
FIG. 9 shows the attachment part-transport unit together with the vehicle crane part of FIG. 8 in a changed state.

FIG. 9 shows the result of a subsequent pivoting movement S of the two loading arms 13 about the rotational spindle(s) 14 thereof in combination with the change in length thereof by a telescoping movement T, whereby the free load-bearing ends 15 thereof are now coupled in each case to a coupling point 7*f* located in the region of the first end section 7*a* of the bracing device 7. As can be seen for example in FIG. 8, the coupling points 7*f* have an almost semi-circular depression in which the free load-bearing ends 15 of the loading arms 13 can engage in an articulated manner such that an almost rotating relative movement between the free load-bearing ends 15 and the bracing device 7 is permitted even in the coupling state. The pivoting movement S of the two loading arms 13 is based on a linear movement M2 lengthening the two pivot drives 16.

Figure 10:
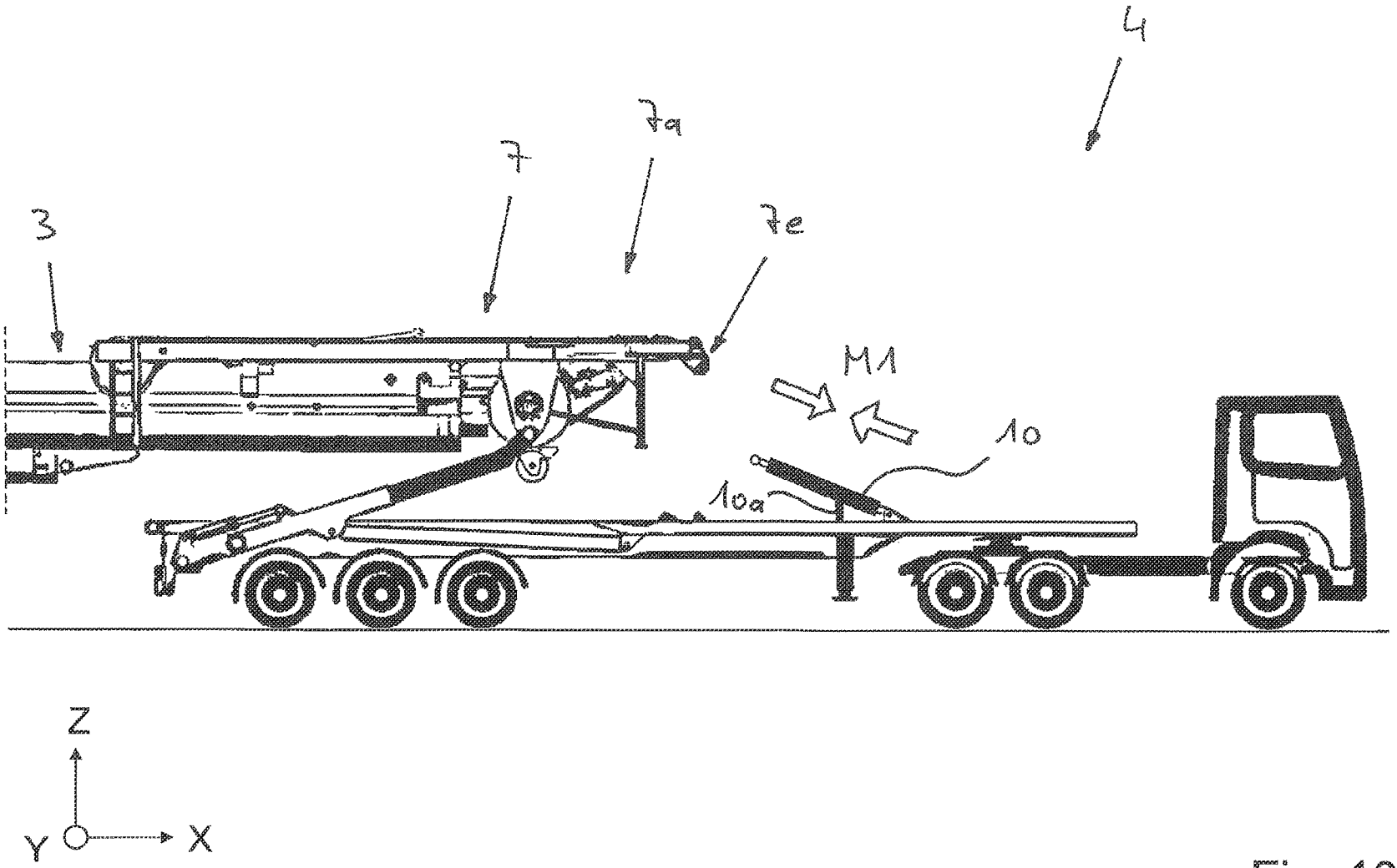
FIG. 10 shows the attachment part-transport unit together with the vehicle crane part of FIG. 9 in a changed state.

FIG. 10 shows that in a next step the tilting drive 10, which is no longer further required, was decoupled from the connecting region 7*e* of the first end section 7*a* of the bracing device 7 and was placed on its storage device 10*a*. Previously or in parallel therewith, the tilting drive 10 was shortened by means of a linear movement M1.

Figure 11:
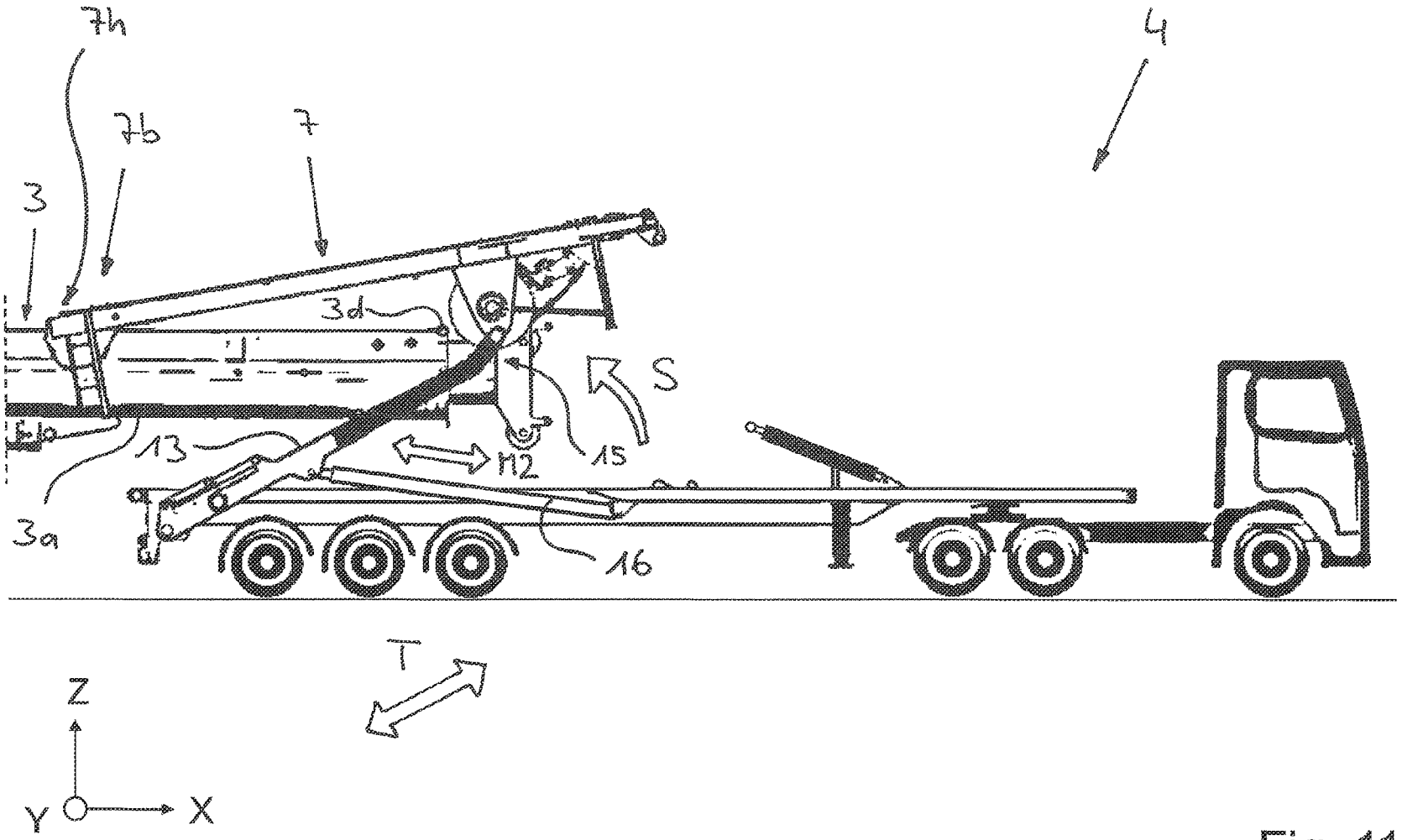
FIG. 11 shows the attachment part-transport unit together with the vehicle crane part of FIG. 10 in a changed state.

FIG. 11 illustrates the subsequent raising of the bracing device 7 from the support roller 3*d* of the telescoping jib 3, in that the loading arms 13 were caused to perform a continuing pivoting movement S on the basis of a linear movement M2 further lengthening the pivot drives 16 thereof. This movement can be supported by a continuing telescoping movement T lengthening the loading arms 13. Owing to the forcibly set kinematics, the bracing device 7 is supported on the one hand on the free load-bearing ends 15 of the loading arms 13 and on the other hand via its second end section 7*b* on the telescoping jib 3, wherein the latter occurs in a sliding and/or rolling manner on the basic box 3*a* thereof. For this purpose, the bracing device 7 comprises at least one rolling and/or sliding body 7*h* which is located on its second end section 7*b* and is not shown in more detail here and via which the second end section 7*b* of the bracing device 7 can be displaced in parallel with the longitudinal direction of the telescoping jib 3 on its basic box 3*a*. In the case of designing the bracing device 7 as a superlift, the rolling and/or sliding body 7*h* can then be arranged e.g. on its connecting element located between its bracing arms.

Figure 12:
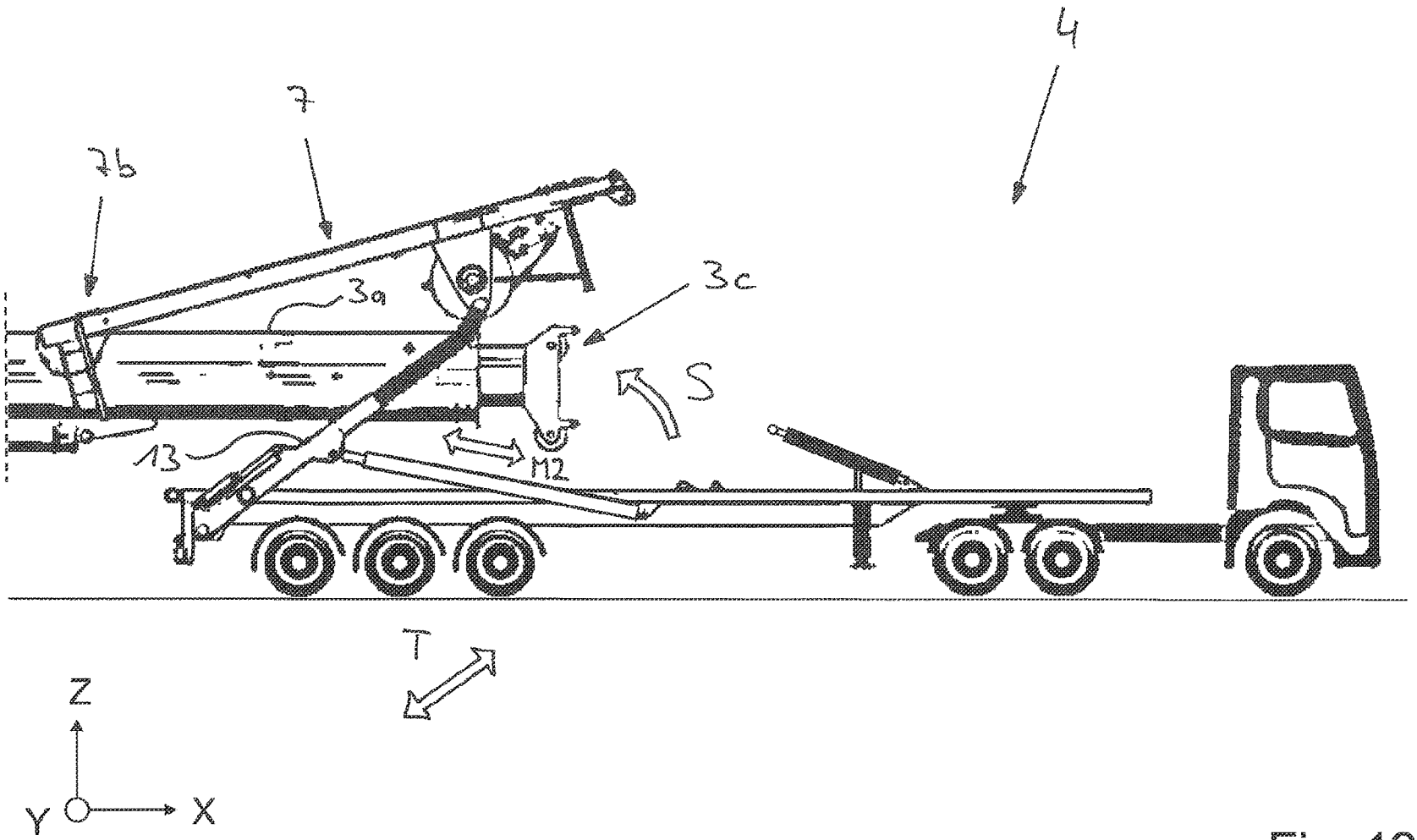
FIG. 12 shows the attachment part-transport unit together with the vehicle crane part of FIG. 11 in a changed state.

FIG. 12 shows that as the two loading arms 13 perform an increasing pivoting movement S and/or telescoping movement T, the second end section 7*b* of the bracing device 7 is displaced further away from the head section 3*c* of the telescoping jib 3 on the basic box 3*a* thereof.

Figure 13:
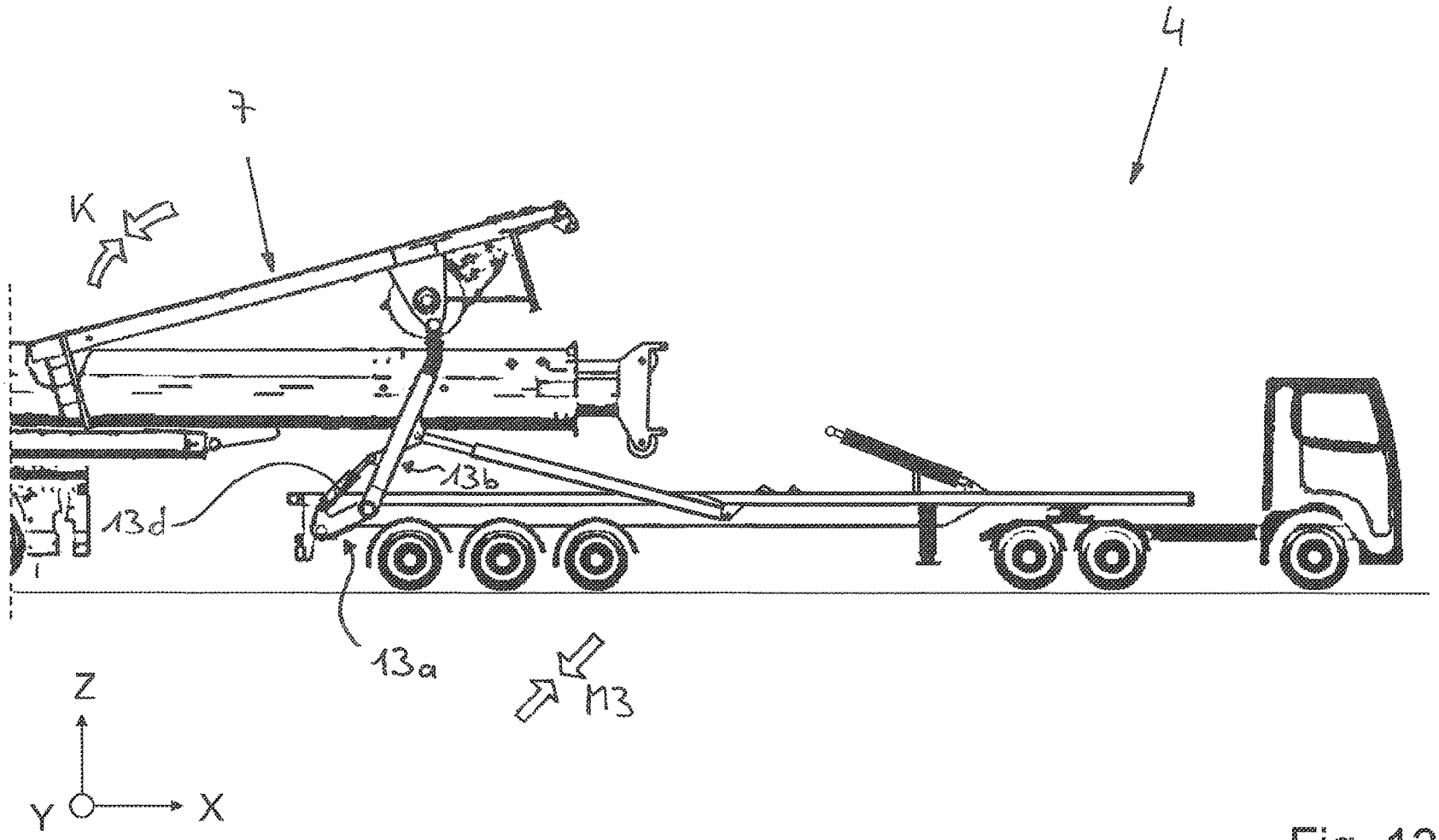
FIG. 13 shows the attachment part-transport unit together with the vehicle crane part of FIG. 12 in a changed state.

FIG. 13 shows a further step in which the joint drive 13*d* arranged between the two arm sections 13*a*, 13*b*, connected together in an articulated manner, of each loading arm 13 is actuated such that the two arm sections 13*a*, 13*b* are pivoted towards each other via a folding movement K owing to a linear movement M3 shortening the joint drive. In other words, the respective upper arm section 13*b* is folded in a limited manner with respect to the associated lower arm section 13*a*.

Figure 14:
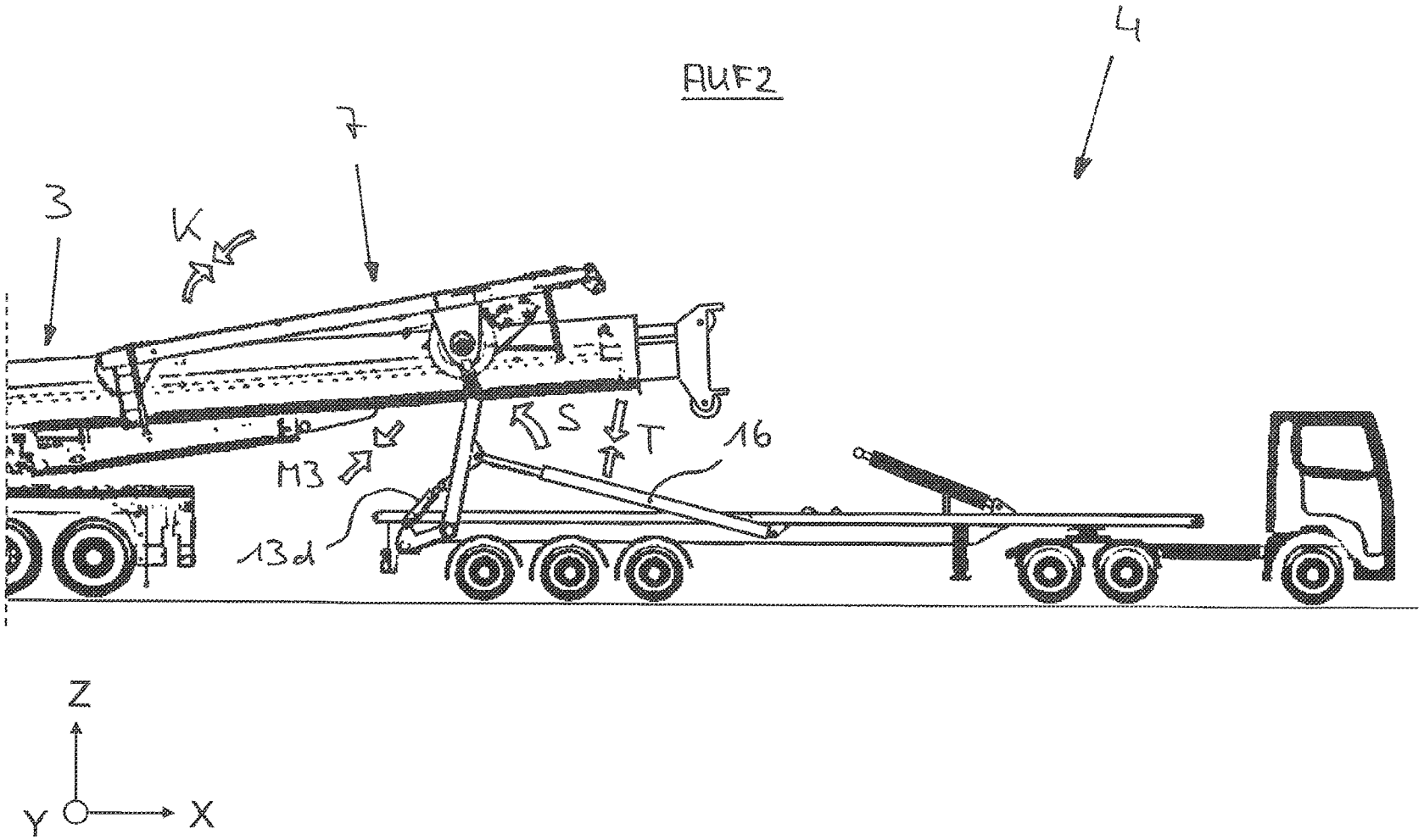
FIG. 14 shows the attachment part-transport unit together with the vehicle crane part of FIG. 13 in a changed state.

FIG. 14 illustrates a second setting-up movement AUF2 in which owing to a parallel or mutually separate actuation of the pivot drives 13*d* and joint drive 16 and the length-adjustability of the loading arms 13 a combination translational and limited rotational sequence of pivoting movement S, folding movement K and the telescoping movement T shortening the two loading arms 13 is performed until the bracing device 7 is lowered as far as possible in the direction of the basic box 3*a* of the telescoping jib 3.

Figure 15:
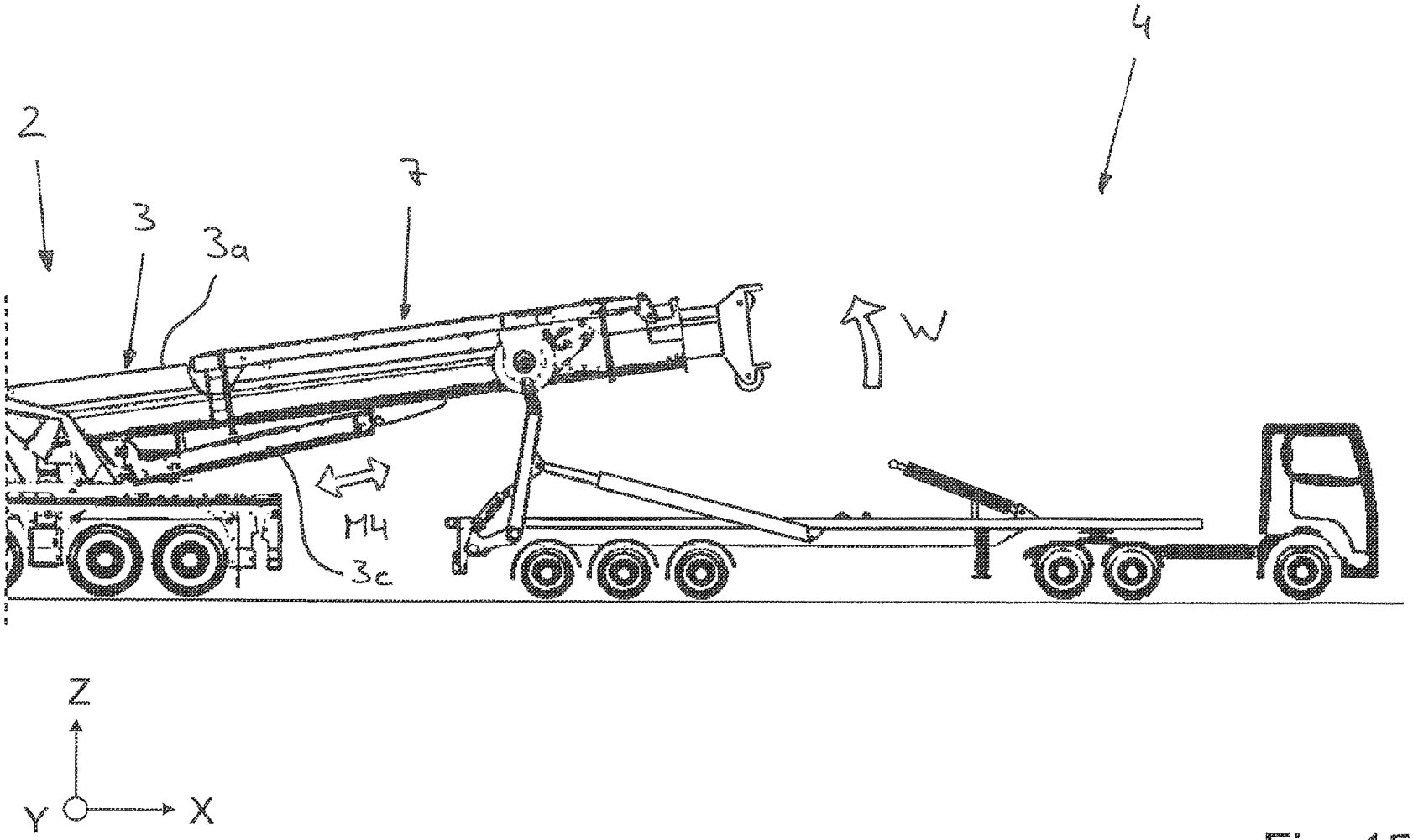
FIG. 15 shows the attachment part-transport unit together with the vehicle crane part of FIG. 14 in a changed state.

FIG. 15 shows the state of the bracing device 7 in which it is placed completely on the basic box 3*a* of the telescoping jib 3. For this purpose, the luffing cylinder 3*b* of the vehicle crane 2 is lengthened by a linear movement M4, whereby the telescoping jib 3 was raised from the ground U from its orientation—previously still extending in parallel with the horizontal direction X—via a corresponding luffing movement W such that the basic box 3*a* thereof was now displaced completely below the bracing device 7.

Figure 16:
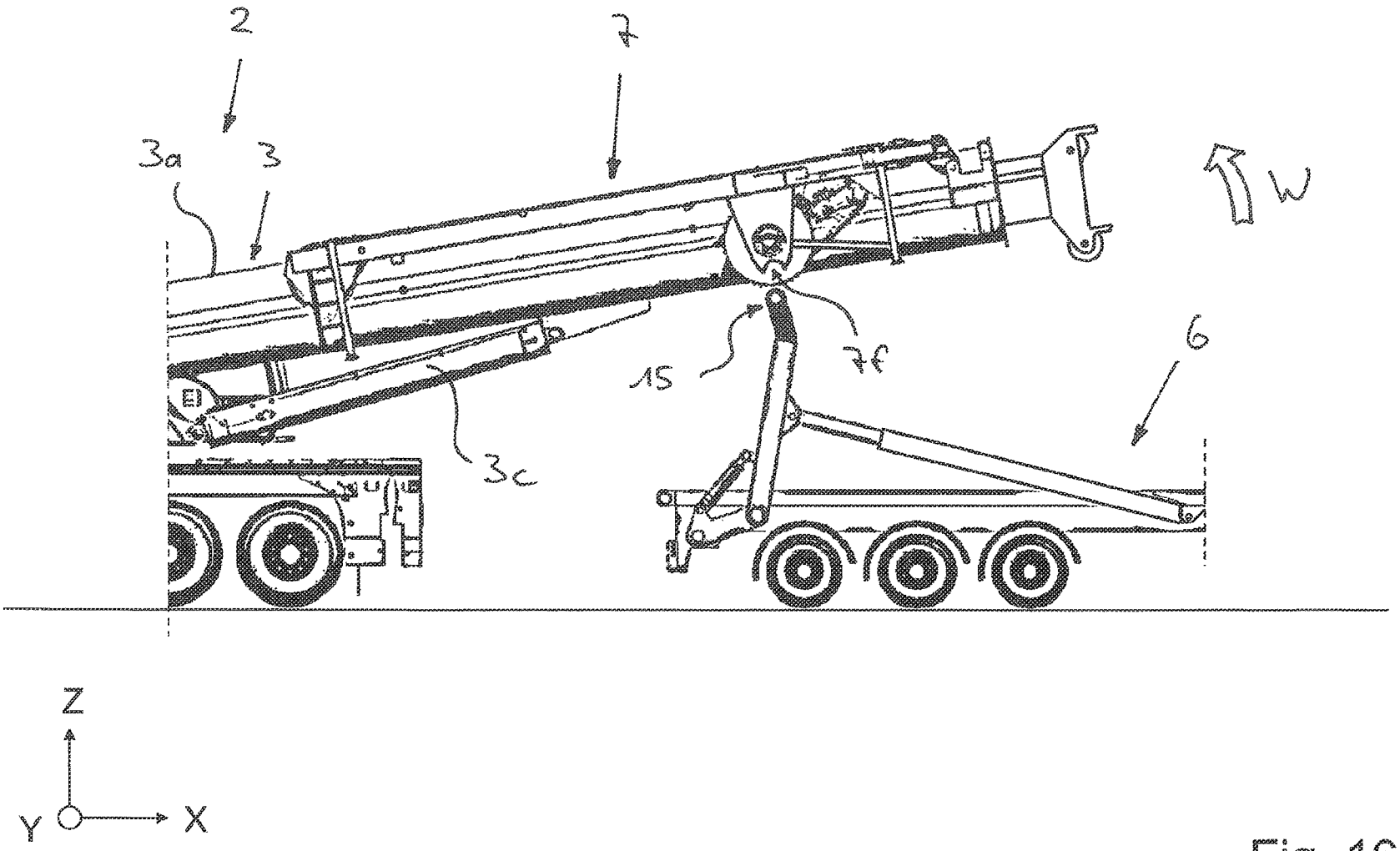
FIG. 16 shows the attachment part-transport unit together with the vehicle crane part of FIG. 15 in a changed state.

FIG. 16 shows that the coupling points 7*f* of the bracing device 7—owing to the luffing movement W of the telescoping jib 3 which is already described in FIG. 15 or a continuing luffing movement—were raised from the free load-bearing ends 15 of the two loading arms 13 and in this respect were decoupled therefrom.

Figure 17:
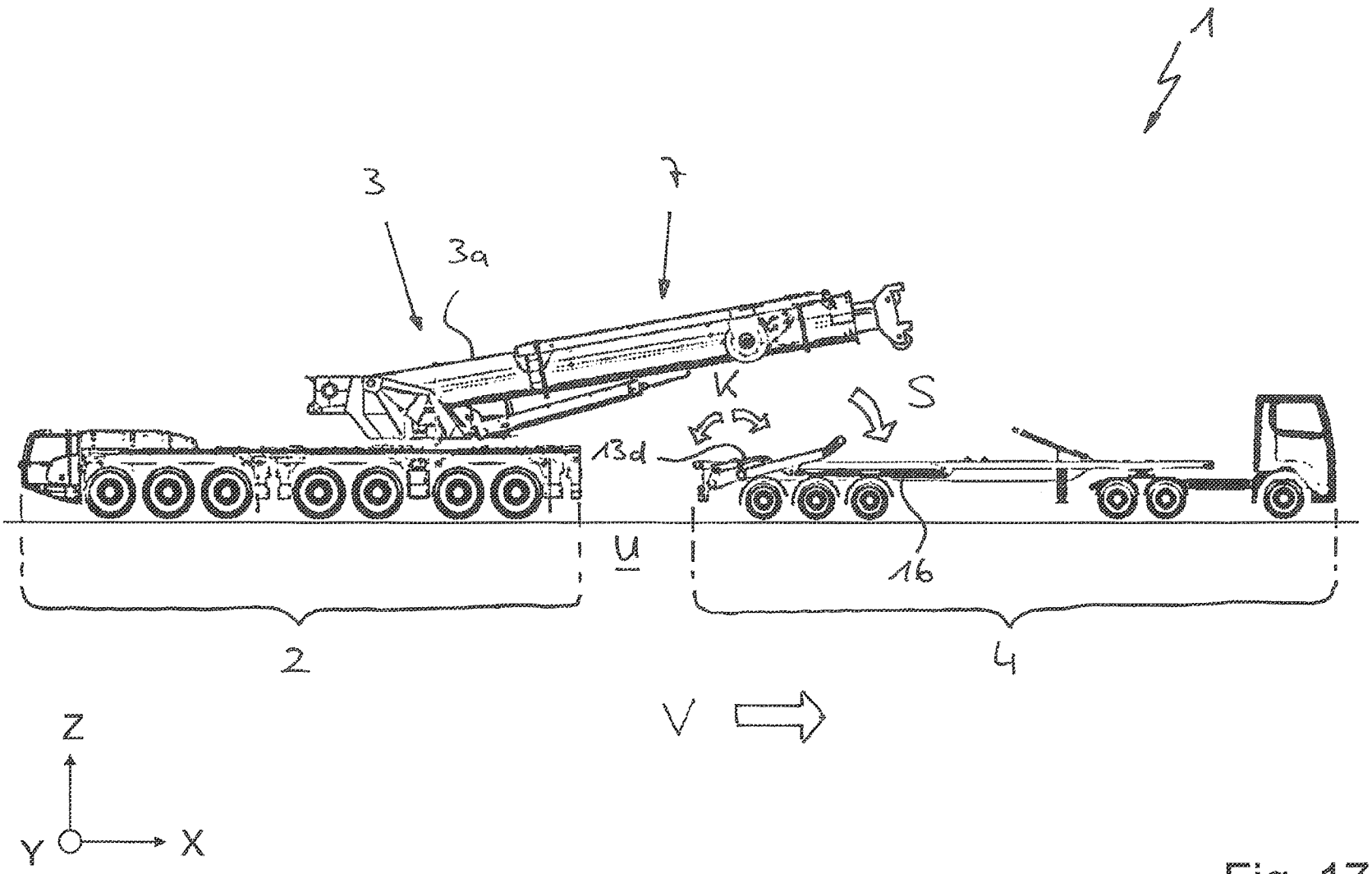
FIG. 17 shows the vehicle crane system of FIGS. 1 and 5 in a changed state.

FIG. 17 shows the situation shortly before the movement of the vehicle crane 2 away from the attachment part-transport system 4 or vice-versa by means of a travelling movement V. At this point in time, the bracing device 7 is now completely transferred and was connected to the basic box 3*a* of the telescoping jib 3 in a manner not illustrated in more detail, e.g. by bolting. Previously or subsequent thereto, the pivot drives 16 and the joint drives 13*d* are actuated in such a manner until the two loading arms 13 are pivoted back in the direction of the loading surface 6*a* of the transport apparatus 6 via a corresponding tilting movement K and pivoting movement S.

The bracing device 7 is transferred from a telescoping jib 3 of the vehicle crane 2 back to the transport apparatus 6 of the attachment part-transport unit 4 in the reverse manner, as already shown in the rest of the description and which can be followed in a logical manner using FIGS. 1 to 17 explained herein. For this purpose, inter alia movements in terms of a first setting-down movement AB1 and a second setting-down movement AB2 are performed. Of these, the first setting-down movement AB1 corresponds to a movement performed in the opposite direction to the second setting-up movement AUF2, whilst the second setting-down movement AB2 is a movement opposite to the first setting-up movement AUF1.

The invention claimed is:

1. A vehicle crane system comprising:

a vehicle crane having a telescoping jib and an attachment part configured as a bracing device that can be selectively mounted on and removed from the telescoping jib;

an attachment part-transport unit configured to transport the attachment part, wherein the attachment part-transport unit comprises a mobile transport apparatus configured to transport the attachment part and has at least one loading arm, wherein the at least one loading arm has a free load-bearing end that is able to be coupled to the attachment part that is received or is to be received onto the transport apparatus, and wherein the loading arm is arranged so as to be movable on the transport apparatus such that the attachment part can be transferred between the transport apparatus and the telescoping jib;

wherein the transport apparatus has a tilting device that is configured to raise and lower, only on one side, the attachment part that is received or is to be received on the transport apparatus;

wherein the attachment part has a first end section and has a second end section opposite the first end section, and wherein the tilting device comprises at least one support assembly and a tilting drive configured as a linear drive that is configured for coupling to the first end section of the attachment part, wherein the support assembly and the tilting drive are configured to raise or lower the second end section of the attachment part with the first end section coupled to the linear drive and the attachment part supported at the support assembly resulting in a pivoting movement of the attachment part about the support assembly.

2. The vehicle crane system as claimed in claim 1, wherein the at least one loading arm is pivotably arranged on the transport apparatus such that the attachment part to be loaded or unloaded can move on a path having a movement component in a vertical direction and a horizontal direction.

3. The vehicle crane system as claimed in claim 2, wherein the telescoping jib includes a basic box, and wherein the attachment part when supported on the basic box and coupled to the tilting drive of the tilting device can be caused to perform by a change in length of the tilting drive either (a) a combined translational and limited rotational first setting-up movement relative to the transport apparatus so as to move away from the transport apparatus and towards the vehicle crane, or (b) a combined translational and limited rotational second setting-down movement relative to the transport apparatus so as to move towards the transport apparatus and away from the vehicle crane.

4. The vehicle crane system as claimed in claim 2, wherein the tilting drive includes a first end and is arranged to be pivotable on the transport apparatus via the first end, and wherein the tilting device has a storage device on which the tilting drive can be placed in a position raised from a horizontal.

5. The vehicle crane system as claimed in claim 1, wherein the attachment part comprises sections and is configured to be placed at least in sections on the telescoping jib of the vehicle crane, and wherein when the attachment part is coupled to the free load-bearing end of the at least one loading arm the attachment part can be caused to perform by a movement and/or a change in length of the loading arm either (a) a combined translational and limited rotational first setting-down movement relative to the telescoping jib so as to move towards the transport apparatus and away from the vehicle crane, or (b) a combined translational and limited rotational second setting-up movement relative to the telescoping jib so as to move away from the transport apparatus and towards the vehicle crane.

6. The vehicle crane system as claimed in claim 1, wherein the bracing device comprises a sideways superlift.

7. The vehicle crane system as claimed in claim 1, wherein the at least one loading arm can be actively pivoted.

8. The vehicle crane system as claimed in claim 1, wherein the at least one loading arm comprises two mutually spaced apart loading arms, and wherein movements of the two loading arms can be performed synchronously with respect to one another and/or independently of one another.

9. The vehicle crane system as claimed in claim 1, wherein the transport apparatus has a loading surface, and wherein the at least one loading arm can be pivoted via a rotational spindle disposed below the loading surface.

10. The vehicle crane system as claimed in claim 1, further comprising a pivot drive arranged between the at least one loading arm and the transport apparatus, wherein the pivot drive is configured as a linear drive whose length can be changed for performing a pivoting movement of the loading arm.

11. The vehicle crane system as claimed in claim 1, wherein the at least one loading arm is divided into a lower arm section and an upper arm section, and wherein the two arm sections are connected together and can be folded relative to each other via a joint.

12. A method for transferring an attachment part in the form of a bracing device from a transport apparatus of an attachment part-transport unit of a vehicle crane system (1) onto a telescoping jib of a vehicle crane of the vehicle crane system, wherein the transport apparatus further comprises a tilting device and two length-adjustable loading arms, wherein the loading arms are arranged so as to be movable on the transport apparatus and have free load-bearing ends that are able to be coupled to the attachment part, and wherein the tilting device is configured to raise the attachment part from the transport apparatus;

said method comprising:

providing the attachment part-transport unit having the received bracing device in the region of the vehicle crane;

arranging the transport apparatus and telescoping jib relative to each other such that a longitudinal direction of the bracing device is oriented with respect to a longitudinal direction of the telescoping jib;

coupling a tilting drive of the tilting device arranged on a loading surface of the transport apparatus to a first end section of the bracing device;

actuating the tilting drive so as to shorten the tilting drive such that the bracing device supported at least in regions on a support assembly of the tilting device is tilted about the support assembly until a second end section of the bracing device opposite the first end section is raised with respect to the loading surface of the transport apparatus;

bringing the vehicle crane closer to the transport apparatus such that the telescoping jib is arranged at least in sections beneath the second end section of the bracing device;

actuating the tilting drive so as to lengthen the tilting drive such that the bracing device is tilted back about the support assembly and the second end section thereof is lowered in the direction of a head section of the telescoping jib until the bracing device is supported on at least one support roller arranged on the telescoping jib;

actuating the tilting drive so as to further lengthen the tilting drive via a first setting-up movement such that the bracing device is lifted out of the support assembly and the bracing device is placed at least in sections on the telescoping jib, wherein the first setting-up movement occurs in a sliding and/or rolling manner about the support roller of the telescoping jib and is a combined translational and limited rotational movement;

orienting the two length-adjustable loading arms arranged on the transport apparatus by actuating at least one pivot drive pivoting the loading arms and the length adjustability thereof until the free load-bearing ends thereof are coupled in each case to a coupling point of the bracing device, wherein the coupling point is located in the region of the first end section;

decoupling the tilting drive of the tilting device from the bracing device;

pivoting and/or lengthening the two loading arms until the bracing device supported via its second end section on the telescoping jib in a sliding and/or rolling manner is raised from the support roller of the telescoping jib;

actuating, at the same time or following the pivoting and/or lengthening of the two loading arms, a joint drive arranged between an upper arm section and a lower arm section of each loading arm, where the upper arm section and lower arm section are connected together in an articulated manner, such that the upper arm section is folded down against the lower arm section of the respective loading arm;

actuating, in a parallel or mutually separate manner, the pivot drive and the joint drive and a length-adjustability of the loading arms such that a second setting-up movement comprising a combined translational and limited rotational movement is performed until the bracing device is placed completely on the telescoping jib;

actuating a luffing cylinder of the vehicle crane such that the telescoping jib is raised from the transport apparatus until the coupling points of the bracing device are decoupled from the free load-bearing ends of the two loading arms; and actuating, in a parallel or mutually separate manner, the pivot drive and the joint drive until the two loading arms are pivoted back in the direction of the loading surface of the transport apparatus.

13. The method as claimed in claim 12, wherein during or at the end of the first setting-up movement, the bracing device is supported on the support roller of the telescoping jib via at least one projection arranged thereon.

14. The method as claimed in claim 12, further comprising actuating the tilting drive of the tilting device after it is decoupled from the bracing device in such a manner that said tilting drive is shortened.

15. The method as claimed in claim 12, wherein the bracing device when placed completely on the telescoping jib is connected to the telescoping jib via at least one connector.

16. A method for transferring an attachment part in the form of a bracing device from a basic box of a telescoping jib of a vehicle crane onto a transport apparatus of an attachment part-transport unit of a vehicle crane system, wherein the transport apparatus further comprises a tilting device and two length-adjustable loading arms, wherein the loading arms are arranged so as to be movable on the transport apparatus and have free load-bearing ends that are able to be coupled to the attachment part, and wherein the tilting device is configured to lower the attachment part from the transport apparatus;

said method comprising:

providing the attachment part-transport unit in the region of the vehicle crane comprising the telescoping jib with the bracing device located thereon;

actuating, as required, a luffing cylinder of the vehicle crane such that the telescoping jib is raised;

arranging the transport apparatus below the telescoping jib and orienting a longitudinal direction of the transport apparatus with respect to a longitudinal direction of the telescoping jib of the vehicle crane and/or a longitudinal direction of the bracing device;

orienting the two length-adjustable loading arms arranged on the transport apparatus by actuating at least one pivot drive pivoting the loading arms and a joint drive arranged between two arm sections of each loading arm, where the two arm sections of each loading arm are connected to each other in an articulated manner, and the length adjustability thereof in such a manner until the free load-bearing ends thereof are arranged in each case below a coupling point of the bracing device, wherein the coupling point is located in the region of a first end section of the bracing device;

actuating the luffing cylinder of the vehicle crane such that the telescoping jib is lowered towards a loading surface of the transport apparatus until coupling points arranged on the bracing device are coupled to the free load-bearing ends of the loading arms;

actuating the pivot drive and, in a parallel or mutually separate manner, actuating the joint drive to lengthen the loading arms such that a first setting-down movement is performed that comprises a combined translational and limited rotational movement while the bracing device is supported on the telescopic jib in a sliding and/or rolling manner via a second end section of the bracing device until the first end section of the bracing device that is opposite from the second end and is facing the transport apparatus is raised from the telescoping jib;

actuating the pivot drive and/or, in a parallel or mutually separate manner, shortening the two loading arms in such a manner until the bracing device that is supported on the telescoping jib in a sliding and/or rolling manner via its second end section is placed with its first end section at least in part protruding over a head section of the telescoping jib on the telescoping jib (3);

actuating the pivot drive and/or, in a parallel or mutually separate manner, shortening the two loading arms such that their free load-bearing ends are decoupled from the coupling points of the bracing device and are lowered in the direction of the loading surface of the transport apparatus;

coupling a tilting drive of the tilting device arranged on the loading surface of the transport apparatus to the first end section of the bracing device;

actuating the tilting drive so as to shorten the tilting drive such that the bracing device is tilted via a second setting-down movement that is a combined translational and limited rotational movement and is effected about at least one support roller arranged on the telescoping jib until the second end section of the bracing device is raised from the telescoping jib and the first end section of the bracing device that is supported on the support roller in a sliding and/or rolling manner is supported at least in regions on a support assembly of the tilting device;

actuating the tilting drive so as to further shorten the tilting drive such that the bracing device is tilted about the support assembly until the bracing device is completely raised from the telescoping jib;

moving the vehicle crane away from the attachment part-transport unit until the telescoping jib is moved out of a region located between the tilted bracing device and the loading surface of the transport apparatus;

actuating the tilting drive such that the bracing device is tilted back about the support assembly and is lowered in the direction of the loading surface of the transport apparatus until the second end section of the bracing device is supported at least in part on the loading surface of the transport apparatus; and decoupling the tilting drive of the tilting device from the bracing device.

17. The method as claimed in claim 16, wherein during or at the end of the second setting-down movement, the bracing device is supported on the support roller of the telescoping jib via at least one projection arranged thereon.

18. The method as claimed in claim 16, the tilting drive of the tilting device is lengthened prior to being coupled to the first end section of the bracing device and/or is shortened after being decoupled from the bracing device by an actuation of the tilting drive.

19. The method as claimed in claim 16, wherein a connector connecting the bracing device to the telescoping jib is released prior to raising the bracing device from the telescoping jib.

* * * * *